US010556730B2

(12) United States Patent
Baldino et al.

(10) Patent No.: US 10,556,730 B2
(45) **Date of Patent: *Feb. 11, 2020**

(54) CARTON WITH HANDLE

(71) Applicant: Graphic Packaging International, LLC, Atlanta, GA (US)

(72) Inventors: Mark Baldino, Marietta, GA (US); Aaron Lee Bates, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/264,788

(22) Filed: Feb. 1, 2019

(65) Prior Publication Data

US 2019/0161258 A1 May 30, 2019

Related U.S. Application Data

(60) Continuation of application No. 15/811,824, filed on Nov. 14, 2017, now Pat. No. 10,233,000, which is a (Continued)

(51) Int. Cl.
*B65D 71/36* (2006.01)

(52) U.S. Cl.
CPC ..... *B65D 71/36* (2013.01); *B65D 2571/005* (2013.01); *B65D 2571/0045* (2013.01); (Continued)

(58) Field of Classification Search
CPC ..... B65D 71/36; B65D 2571/00728; B65D 2571/00574; B65D 2571/00444; B65D 2571/0045; B65D 2571/00543 (Continued)

(56) References Cited

U.S. PATENT DOCUMENTS 902,347 A 10/1908 Tillinghast
1,541,143 A 6/1925 Hoile
(Continued)

FOREIGN PATENT DOCUMENTS

BE 671 762 3/1966
CA 2 172 379 12/1995
(Continued)

OTHER PUBLICATIONS

International Search Report and Written Opinion for PCT/US2016/031154 dated Aug. 17, 2016.
(Continued)

*Primary Examiner* — Steven A. Reynolds
(74) *Attorney, Agent, or Firm* — Womble Bond Dickinson (US) LLP

(57) ABSTRACT

A package including a carton and a plurality of articles. The carton can include a plurality of panels that extends at least partially around an interior of the carton. The plurality of articles can be arranged in a plurality of rows of articles in the interior of the carton, the plurality of rows of articles can include at least a first row and a second row, and the first row can include at least one more article than the second row forming a void between a first article at an end of the first row and a second article at an end of the second row. A handle can include the first article at the end of the first row and a handle feature extending in the carton. The handle feature can be at least partially aligned with the void and can be proximate the first article.

45 Claims, 25 Drawing Sheets

Related U.S. Application Data division of application No. 15/148,189, filed on May 6, 2016, now Pat. No. 9,845,182.

(60) Provisional application No. 62/179,446, filed on May 7, 2015.

(52) U.S. Cl.
CPC ..... *B65D 2571/0066* (2013.01); *B65D 2571/00141* (2013.01); *B65D 2571/00444* (2013.01); *B65D 2571/00543* (2013.01); *B65D 2571/00574* (2013.01); *B65D 2571/00592* (2013.01); *B65D 2571/00728* (2013.01)

(58) Field of Classification Search
USPC ..... 206/427, 433
See application file for complete search history.

(56) References Cited

U.S. PATENT DOCUMENTS 1,913,650 A 6/1933 White
1,925,102 A 9/1933 Levkoff
2,001,478 A 5/1935 Vogt
2,115,673 A 4/1938 Stompe
2,124,808 A 7/1938 White et al.
D124,610 S 1/1941 Norton
2,448,819 A 9/1948 Mitchell
2,535,880 A 12/1950 Tomkins
2,554,190 A 5/1951 Hennessey
2,605,035 A 7/1952 Williamson
2,718,301 A 9/1955 Palmer
2,718,313 A 9/1955 O'Neil
2,723,027 A 11/1955 Guyer
2,754,047 A 7/1956 Schmidt et al.
2,756,553 A 7/1956 Ferguson
2,782,578 A 2/1957 Madden
2,783,690 A 3/1957 Crary et al.
2,796,709 A 6/1957 Bolding
2,798,603 A 7/1957 Grinspoon
2,800,224 A 7/1957 Taylor et al.
2,842,304 A 7/1958 Ringler
2,849,111 A 8/1958 Fielding
2,854,183 A 9/1958 Srofe
2,868,431 A 1/1959 Painter
2,891,361 A 6/1959 Walter
RE24,667 E 7/1959 Fielding
2,919,844 A 1/1960 Anderson, Jr.
2,922,561 A 1/1960 Currivan
2,928,541 A 3/1960 Fielding
2,929,497 A 3/1960 De Million-Czarnecki
2,930,516 A 3/1960 Fowle et al.
2,974,848 A 3/1961 Fielding
2,975,891 A 3/1961 Stone
2,990,097 A 6/1961 Thompson
3,002,651 A 10/1961 Gauld
3,018,031 A 1/1962 Ahlbor et al.
3,060,659 A 10/1962 Blais
3,080,050 A 3/1963 Fielding
3,176,902 A 4/1965 Champlin
3,178,242 A 4/1965 Ellis
3,207,411 A 9/1965 Farquhar
3,228,582 A 1/1966 Osberg
3,237,762 A 3/1966 Wood
3,252,649 A 5/1966 Graser et al.
3,263,861 A 8/1966 Carr
3,265,283 A 8/1966 Farquhar
RE26,083 E 9/1966 Forrer
3,300,115 A 1/1967 Schauer
3,306,519 A 2/1967 Wood
3,332,594 A 7/1967 Capua
3,339,723 A 9/1967 Wood
3,343,660 A 9/1967 Bailey
3,356,279 A 12/1967 Root
3,356,283 A 12/1967 Champlin
3,373,867 A 3/1968 Wood
3,429,496 A 2/1969 Hickin
3,447,672 A 6/1969 Bailey et al.
3,517,858 A 6/1970 Farquhar
3,540,581 A 11/1970 Koolnis
3,541,757 A 11/1970 Bertrand
3,557,521 A 1/1971 Pierce, Jr.
3,592,000 A 7/1971 Kapare
3,593,849 A 7/1971 Helms
3,599,858 A 8/1971 Samsing
3,635,452 A 1/1972 Helms
3,669,251 A 6/1972 Phillips
3,669,342 A 6/1972 Funkhouser
3,669,343 A 6/1972 Howard
3,688,972 A 9/1972 Mahon
3,747,835 A 7/1973 Graser
3,765,527 A 10/1973 Vargo
3,767,042 A 10/1973 Ganz
3,807,624 A 4/1974 Funkhouser
3,894,681 A 7/1975 Arneson et al.
3,904,036 A 9/1975 Forrer
3,913,739 A 10/1975 Hennessey
3,942,631 A 3/1976 Sutherland et al.
3,963,121 A 6/1976 Kipp
3,986,319 A 10/1976 Puskarz
4,000,811 A 1/1977 Hardinson et al.
4,004,500 A 1/1977 Wood
D243,508 S 3/1977 Killy
4,010,593 A 3/1977 Graham
4,030,596 A 6/1977 Snyder et al.
4,096,985 A 6/1978 Wood
4,098,050 A 7/1978 Dietz
4,101,069 A 7/1978 Wood
4,149,355 A 4/1979 Clegg
D252,259 S 7/1979 Rinehart
4,195,765 A 4/1980 Roccaforte et al.
4,200,220 A 4/1980 Ganz
4,202,446 A 5/1980 Sutherland
4,214,660 A 7/1980 Hunt, Jr.
4,216,861 A 8/1980 Oliff
4,222,485 A 9/1980 Focke
D261,861 S 11/1981 Carter
D263,204 S 3/1982 Dutcher
4,318,474 A 3/1982 Hasegawa
4,325,482 A 4/1982 Feeser
4,328,893 A 5/1982 Oliff et al.
4,364,509 A 12/1982 Holley, Jr. et al.
4,375,258 A 3/1983 Crayne et al.
D269,068 S 5/1983 Mann et al.
4,394,903 A 7/1983 Bakx
D270,041 S 8/1983 Vestal
4,396,143 A 8/1983 Killy
4,416,410 A 11/1983 Herrmann
4,417,655 A 11/1983 Forbes, Jr.
4,417,661 A 11/1983 Roccaforte
4,421,232 A 12/1983 Konaka
4,424,901 A 1/1984 Lanier
4,440,340 A 4/1984 Bakx
4,465,180 A 8/1984 Klygis
4,482,090 A 11/1984 Milliens
4,498,581 A 2/1985 Dutcher
4,508,258 A 4/1985 Graser
4,519,182 A 5/1985 Lever et al.
4,523,676 A 6/1985 Barrash
4,566,593 A 1/1986 Muller
4,577,762 A 3/1986 Kuchenbecker
4,582,199 A 4/1986 Schuster
D286,987 S 12/1986 Golan et al.
4,726,471 A 2/1988 Whately et al.
4,735,315 A 4/1988 Oliff et al.
4,742,915 A 5/1988 Ringer
4,747,485 A 5/1988 Chaussadas
4,747,487 A 5/1988 Wood
4,756,139 A 7/1988 Le Bras
4,756,419 A 7/1988 Le Bras
4,784,266 A 11/1988 Chaussadas
4,785,991 A 11/1988 Schuster
4,804,089 A 2/1989 Wilson
4,817,797 A 4/1989 Hamelin

(56) References Cited

U.S. PATENT DOCUMENTS

| | | | |
|---|---|---|---|
| D303,090 | S | 8/1989 | Armor et al. |
| 4,860,943 | A | 8/1989 | Cooper |
| 4,860,944 | A | 8/1989 | Wonnacott |
| 4,875,585 | A | 10/1989 | Kadleck et al. |
| 4,890,440 | A | 1/1990 | Romagnoli |
| 4,901,849 | A | 2/1990 | Wilson |
| 4,919,266 | A | 4/1990 | McIntosh, Jr. et al. |
| 4,949,845 | A | 8/1990 | Dixon |
| 4,966,324 | A | 10/1990 | Steel |
| 4,972,991 | A | 11/1990 | Schuster |
| 4,974,771 | A | 12/1990 | Lavery |
| 4,981,253 | A | 1/1991 | Quaintenance |
| 5,000,313 | A | 3/1991 | Oliff |
| 5,002,186 | A | 3/1991 | Cooper |
| 5,031,825 | A | 7/1991 | Romagnoli |
| 5,042,660 | A | 8/1991 | Carver |
| 5,060,792 | A | 10/1991 | Oliff |
| 5,067,615 | A | 11/1991 | Davitian |
| 5,094,347 | A | 3/1992 | Schuster |
| 5,101,642 | A | 4/1992 | Alexandrov |
| 5,107,986 | A | 4/1992 | Cooper |
| 5,123,589 | A | 6/1992 | Cote |
| 5,131,588 | A | 7/1992 | Oliff |
| 5,137,211 | A | 8/1992 | Summer et al. |
| 5,170,934 | A | 12/1992 | Lemoine |
| 5,180,100 | A | 1/1993 | Shimizu |
| D332,915 | S | 2/1993 | Hoell et al. |
| 5,195,676 | A | 3/1993 | LeBras |
| 5,197,656 | A | 3/1993 | Hoell et al. |
| 5,246,112 | A | 9/1993 | Stout et al. |
| 5,277,360 | A | 1/1994 | DeMott |
| 5,279,440 | A | 1/1994 | Fougeres et al. |
| 5,284,292 | A | 2/1994 | Johnson |
| 5,297,673 | A | 3/1994 | Sutherland |
| 5,333,734 | A | 8/1994 | Stout et al. |
| 5,351,878 | A | 10/1994 | Cooper |
| 5,368,194 | A | 11/1994 | Oliff et al. |
| 5,395,043 | A | 3/1995 | Bacques et al. |
| 5,421,458 | A | 6/1995 | Campbell |
| 5,427,242 | A | 6/1995 | Oliff et al. |
| D360,131 | S | 7/1995 | Tudor |
| 5,443,203 | A | 8/1995 | Sutherland |
| D364,087 | S | 11/1995 | Farley |
| 5,465,831 | A | 11/1995 | Smith |
| 5,472,090 | A | 12/1995 | Sutherland |
| 5,472,138 | A | 12/1995 | Ingram |
| 5,485,915 | A | 1/1996 | Harris |
| 5,505,372 | A | 4/1996 | Edson et al. |
| 5,518,111 | A | 5/1996 | Stout |
| 5,536,194 | A | 7/1996 | Larsen et al. |
| 5,542,536 | A | 8/1996 | Sutherland |
| 5,551,556 | A | 9/1996 | Sutherland |
| 5,558,212 | A | 9/1996 | Sutherland |
| 5,558,213 | A | 9/1996 | Sutherland |
| 5,595,339 | A | 1/1997 | Correll |
| 5,597,071 | A | 1/1997 | Sutherland |
| 5,609,251 | A | 3/1997 | Harris |
| 5,622,309 | A | 4/1997 | Matsuda et al. |
| 5,664,401 | A | 9/1997 | Portrait et al. |
| 5,664,683 | A | 9/1997 | Brody |
| 5,682,995 | A | 11/1997 | Sutherland |
| 5,690,213 | A | 11/1997 | Matsumura |
| 5,692,614 | A | 12/1997 | Harris |
| 5,704,470 | A | 1/1998 | Sutherland |
| 5,704,542 | A | 1/1998 | Harrelson |
| 5,722,584 | A | 3/1998 | Fujiwara |
| D393,800 | S | 4/1998 | Harrison |
| 5,765,685 | A | 6/1998 | Roosa |
| 5,775,574 | A | 7/1998 | Whitnell |
| 5,778,630 | A | 7/1998 | Portrait et al. |
| 5,782,343 | A | 7/1998 | Harrelson |
| 5,826,712 | A | 10/1998 | Aikio |
| 5,826,783 | A | 10/1998 | Stout |
| 5,833,118 | A | 11/1998 | Weiss |
| 5,853,088 | A | 12/1998 | Saulas et al. |
| 5,855,318 | A | 1/1999 | Baxter |
| 5,865,312 | A | 2/1999 | Stall |
| 5,873,515 | A | 2/1999 | Dunn et al. |
| 5,875,961 | A | 3/1999 | Stone et al. |
| 5,878,947 | A | 3/1999 | Hoy et al. |
| 5,881,884 | A | 3/1999 | Podosek |
| 5,915,546 | A | 6/1999 | Harrelson |
| 5,921,398 | A | 7/1999 | Carroll |
| 5,924,559 | A | 7/1999 | Carrel et al. |
| 5,931,300 | A | 8/1999 | Sutherland |
| 5,937,620 | A | 8/1999 | Chalendar |
| 5,941,453 | A | 8/1999 | Oliff |
| 5,943,847 | A | 8/1999 | Chalendar |
| 5,947,367 | A | 9/1999 | Miller et al. |
| 5,975,286 | A | 11/1999 | Oliff |
| 6,019,220 | A | 2/2000 | Sutherland |
| 6,021,898 | A | 2/2000 | Sutherland |
| 6,021,899 | A | 2/2000 | Sutherland |
| 6,039,181 | A | 3/2000 | Whiteside |
| 6,085,969 | A | 7/2000 | Burgoyne |
| 6,105,338 | A | 8/2000 | Kalany |
| 6,105,854 | A | 8/2000 | Spivey |
| 6,109,438 | A | 8/2000 | Sutherland |
| 6,155,480 | A | 12/2000 | Botsford et al. |
| 6,158,586 | A | 12/2000 | Muller |
| D436,859 | S | 1/2001 | Botsford et al. |
| 6,176,419 | B1 | 1/2001 | Holley, Jr. |
| 6,227,367 | B1 | 5/2001 | Harrelson et al. |
| 6,241,083 | B1 | 6/2001 | Harrelson |
| D446,114 | S | 8/2001 | Stephens |
| 6,283,293 | B1 | 9/2001 | Lingamfelter |
| 6,289,651 | B1 | 9/2001 | Le Bras |
| 6,315,123 | B1 | 11/2001 | Ikeda |
| D454,784 | S | 3/2002 | Oram |
| 6,378,697 | B1 | 4/2002 | Sutherland et al. |
| 6,378,765 | B1 | 4/2002 | Sutherland |
| 6,386,369 | B2 | 5/2002 | Yuhas et al. |
| 6,409,077 | B1 | 6/2002 | Telesca et al. |
| 6,435,351 | B1 | 8/2002 | Gibb |
| 6,478,219 | B1 | 11/2002 | Holley, Jr. |
| 6,550,615 | B2 | 4/2003 | Linghamfelter |
| 6,550,616 | B2 | 4/2003 | Le Bras |
| 6,578,736 | B2 | 6/2003 | Spivey |
| 6,631,803 | B2 | 10/2003 | Rhodes et al. |
| 6,688,839 | B1 | 2/2004 | Hirschek |
| 6,715,639 | B2 | 4/2004 | Spivey |
| 6,752,262 | B1 | 6/2004 | Boriani et al. |
| 6,789,673 | B2 | 9/2004 | Lingamfelter |
| 6,811,525 | B2 | 11/2004 | Culpepper |
| 6,866,185 | B2 | 3/2005 | Harrelson |
| 6,866,186 | B2 | 3/2005 | Fogle et al. |
| 6,948,651 | B2 | 9/2005 | Ikeda |
| 6,981,631 | B2 | 1/2006 | Fogle et al. |
| 6,988,617 | B2 | 1/2006 | Gomes et al. |
| 7,000,803 | B2 | 2/2006 | Miller |
| 7,007,800 | B2 | 3/2006 | Le Bras |
| 7,025,197 | B2 | 4/2006 | Sutherland |
| 7,048,113 | B2 | 5/2006 | Gomes |
| 7,100,798 | B2 | 9/2006 | Spivey |
| 7,159,759 | B2 | 1/2007 | Sutherland |
| 7,175,020 | B2 | 2/2007 | Sutherland et al. |
| 7,237,674 | B2 | 7/2007 | Auclair |
| 7,427,010 | B2 | 9/2008 | Sutherland |
| 7,448,492 | B2 | 11/2008 | Sutherland |
| 7,644,817 | B2 | 1/2010 | Sutherland |
| 7,677,387 | B2 | 3/2010 | Brand et al. |
| 7,762,395 | B2 | 7/2010 | Sutherland et al. |
| 7,762,397 | B2 | 7/2010 | Coltri-Johnson et al. |
| 7,766,219 | B2 | 8/2010 | Gomes et al. |
| D628,882 | S | 12/2010 | Work |
| 7,870,993 | B2 | 1/2011 | Walling |
| 7,913,844 | B2 | 3/2011 | Spivey, Sr. |
| D636,663 | S | 4/2011 | Work |
| 7,975,841 | B2 | 7/2011 | Marco |
| D645,739 | S | 9/2011 | Ross |
| D646,157 | S | 10/2011 | Work |
| D655,600 | S | 3/2012 | Work |
| 8,235,201 | B2 | 8/2012 | Miller |
| D668,540 | S | 10/2012 | Lutzig |

(56) References Cited

U.S. PATENT DOCUMENTS

| | | | |
|---|---|---|---|
| 8,347,591 | B2 | 1/2013 | Coltri-Johnson |
| 8,376,213 | B2 | 2/2013 | Brand |
| 8,439,254 | B2 | 5/2013 | Smalley |
| D704,049 | S | 5/2014 | Ridenour |
| D705,054 | S | 5/2014 | McCarthy |
| 8,800,852 | B2 | 8/2014 | Schemmel et al. |
| D715,638 | S | 10/2014 | Wollschleger |
| 8,875,869 | B1 | 11/2014 | Burchell |
| D729,060 | S | 5/2015 | Trombetta |
| D747,966 | S | 1/2016 | McClaughry |
| D748,975 | S | 2/2016 | McClaughry |
| D760,072 | S | 6/2016 | Lutz |
| 9,392,888 | B2 | 7/2016 | Spivey, Sr. |
| 9,415,915 | B2 | 8/2016 | Spivey, Sr. et al. |
| 9,434,520 | B2 | 9/2016 | Bates |
| 9,452,874 | B2 | 9/2016 | Harrelson |
| D781,142 | S | 3/2017 | Trujillo |
| D793,224 | S | 8/2017 | Sagardoy Muniesa |
| 9,845,182 | B2 | 12/2017 | Baldino et al. |
| D811,218 | S | 2/2018 | Baldino |
| 2002/0070139 | A1 | 6/2002 | Bates |
| 2002/0088820 | A1 | 7/2002 | Spivey |
| 2002/0088821 | A1 | 7/2002 | Spivey et al. |
| 2002/0185527 | A1 | 12/2002 | Bates |
| 2003/0000182 | A1 | 1/2003 | Portrait et al. |
| 2003/0132130 | A1 | 7/2003 | Bras |
| 2003/0141353 | A1 | 7/2003 | Wilson |
| 2003/0192905 | A1 | 10/2003 | Spivey |
| 2004/0000582 | A1 | 1/2004 | Sutherland |
| 2004/0011674 | A1 | 1/2004 | Theelen |
| 2004/0060972 | A1 | 4/2004 | Harrelson |
| 2004/0069659 | A1 | 4/2004 | Sutherland |
| 2004/0089671 | A1 | 5/2004 | Miller |
| 2004/0099542 | A1 | 5/2004 | Sutherland |
| 2004/0099558 | A1 | 5/2004 | Oliff et al. |
| 2004/0164133 | A1 | 8/2004 | Harrelson |
| 2004/0188277 | A1 | 9/2004 | Auclair |
| 2004/0188301 | A1 | 9/2004 | Gomes |
| 2004/0232034 | A1 | 11/2004 | Lebras |
| 2004/0243277 | A1 | 12/2004 | Bonnain et al. |
| 2004/0254666 | A1 | 12/2004 | Bonnain et al. |
| 2005/0001020 | A1 | 1/2005 | Gamier |
| 2005/0087592 | A1 | 4/2005 | Schuster |
| 2005/0103652 | A1 | 5/2005 | Wilkins |
| 2005/0167290 | A1 | 8/2005 | Sutherland |
| 2005/0178687 | A1 | 8/2005 | Spivey, Sr. |
| 2005/0178791 | A1 | 8/2005 | Miller |
| 2005/0194430 | A1 | 9/2005 | Auclair et al. |
| 2005/0263574 | A1 | 12/2005 | Schuster |
| 2006/0000881 | A1 | 1/2006 | Sutherland |
| 2006/0108406 | A1 | 5/2006 | Stewart et al. |
| 2006/0157545 | A1 | 7/2006 | Auclair |
| 2006/0191811 | A1 | 8/2006 | Fogle et al. |
| 2006/0231604 | A1 | 10/2006 | DeBusk |
| 2006/0254942 | A1 | 11/2006 | Cargile, Jr. |
| 2006/0255108 | A1 | 11/2006 | Shmagin |
| 2006/0261140 | A1 | 11/2006 | Holley, Jr. |
| 2007/0017829 | A1 | 1/2007 | Sutherland |
| 2007/0131748 | A1 | 6/2007 | Brand |
| 2007/0158226 | A1 | 7/2007 | Coltri-Johnson et al. |
| 2007/0227927 | A1 | 10/2007 | Coltri-Johnson |
| 2007/0241017 | A1 | 10/2007 | Sutherland et al. |
| 2008/0237320 | A1 | 10/2008 | Philips |
| 2008/0237324 | A1 | 10/2008 | Walling |
| 2008/0257943 | A1 | 10/2008 | Blin |
| 2010/0044420 | A1 | 2/2010 | Brand et al. |
| 2010/0051494 | A1 | 3/2010 | DeBusk et al. |
| 2010/0072267 | A1 | 3/2010 | May et al. |
| 2011/0036902 | A1 | 2/2011 | Smalley |
| 2011/0131926 | A1 | 6/2011 | Coltri-Johnson |
| 2011/0284624 | A1 | 11/2011 | Debusk et al. |
| 2012/0091190 | A1 | 4/2012 | Smalley et al. |
| 2013/0213991 | A1 | 8/2013 | Harrelson |
| 2013/0264379 | A1 | 10/2013 | Schemmel et al. |
| 2014/0284237 | A1 | 9/2014 | Gosset |
| 2014/0311091 | A1 | 10/2014 | Moncrief |
| 2015/0251828 | A1 | 9/2015 | Spivey, Sr. et al. |
| 2016/0167829 | A1 | 6/2016 | Spivey, Sr. et al. |
| 2016/0194106 | A1 | 7/2016 | Walling |
| 2016/0244202 | A1 | 8/2016 | Alexander et al. |
| 2016/0272393 | A1 | 9/2016 | Kastanek et al. |

FOREIGN PATENT DOCUMENTS

| | | | |
|---|---|---|---|
| CA | 2 542 350 | | 5/2005 |
| DE | 1 192 099 | | 4/1965 |
| DE | 2 323 589 | | 11/1974 |
| DE | 75 10 538 | | 8/1975 |
| DE | 76 06 493 | | 6/1976 |
| DE | 29 33 022 | | 2/1980 |
| DE | 30 07 769 | | 9/1981 |
| DE | 81 35 176 | | 5/1982 |
| DE | G 85 14 718 | | 6/1985 |
| DE | G 86 29 664 | | 5/1987 |
| DE | 36 12 594 | | 10/1987 |
| DE | 91 04 905.9 | | 6/1991 |
| DE | 40 23 043 | | 12/1991 |
| DE | 92 03 858.1 | | 5/1992 |
| DE | 94 12 885 | | 10/1994 |
| DE | 94 13 813 | | 10/1994 |
| DE | 295 19 931 | | 2/1996 |
| DE | 296 02 010 | | 3/1996 |
| DE | 299 09 008 | | 9/1999 |
| DE | 29913585 | | 10/1999 |
| DE | 694 21 620 | | 4/2000 |
| EP | 0 235 852 | | 9/1987 |
| EP | 0 323 596 | | 7/1988 |
| EP | 0 341 089 | A2 | 11/1989 |
| EP | 0 342 088 | | 11/1989 |
| EP | 0 459 658 | | 12/1991 |
| EP | 0 475 147 | | 3/1992 |
| EP | 0 509 749 | | 10/1992 |
| EP | 0 520 411 | | 12/1992 |
| EP | 0 752 370 | | 1/1997 |
| EP | 0 849 189 | | 6/1998 |
| EP | 0 899 200 | A1 | 3/1999 |
| EP | 1 060 998 | | 12/2000 |
| EP | 1 262 417 | | 12/2002 |
| EP | 1 334 033 | B1 | 1/2006 |
| EP | 1 612 157 | A2 | 1/2006 |
| EP | 1 518 792 | B1 | 5/2011 |
| EP | 2 557 049 | B1 | 5/2016 |
| FR | 2 456 039 | | 12/1980 |
| FR | 2 549 010 | | 1/1985 |
| FR | 2 581 970 | | 11/1986 |
| FR | 2 698 074 | | 5/1994 |
| JP | 41-18199 | | 10/1941 |
| JP | 5-112373 | | 5/1993 |
| JP | 9-507821 | | 8/1997 |
| JP | 2003-252323 | | 9/2003 |
| KR | 10-2009-0079640 | A | 7/2009 |
| WO | WO 88/09750 | | 12/1988 |
| WO | WO 89/12008 | A1 | 12/1989 |
| WO | WO 95/01284 | | 1/1995 |
| WO | WO 95/25668 | | 9/1995 |
| WO | WO 96/14253 | | 5/1996 |
| WO | WO 96/29260 | | 9/1996 |
| WO | WO 97/21607 | | 6/1997 |
| WO | WO 97/27124 | | 7/1997 |
| WO | WO 98/31593 | | 7/1998 |
| WO | WO 98/38099 | | 9/1998 |
| WO | WO 99/64301 | | 12/1999 |
| WO | WO 00/23334 | | 4/2000 |
| WO | WO 00/71428 | | 11/2000 |
| WO | WO 00/78634 | | 12/2000 |
| WO | WO 01/28871 | | 4/2001 |
| WO | WO 02/04302 | | 1/2002 |
| WO | WO 02/30785 | | 4/2002 |
| WO | WO 02/085739 | | 10/2002 |
| WO | WO 02/085742 | A1 | 10/2002 |
| WO | WO 02/102208 | | 12/2002 |
| WO | WO 03/008292 | | 1/2003 |
| WO | WO 03/082686 | | 10/2003 |
| WO | WO 2004/043790 | | 5/2004 |

(56) References Cited

FOREIGN PATENT DOCUMENTS

| | | | |
|---|---|---|---|
| WO | WO 2004/087507 | | 10/2004 |
| WO | WO 2005/042370 | | 5/2005 |
| WO | WO 2005/092735 | | 10/2005 |
| WO | WO 2007/019000 | | 2/2007 |
| WO | WO 2007/126977 | | 11/2007 |
| WO | WO 2009/015320 | | 1/2009 |
| WO | WO 2013/170123 | A1 | 11/2013 |
| WO | WO 2014/052514 | A | 4/2014 |
| WO | WO 2014/172409 | | 10/2014 |
| WO | WO 2015/034856 | A1 | 3/2015 |

OTHER PUBLICATIONS

Office Action for U.S. Appl. No. 15/148,189 dated Oct. 18, 2016.
Response to Restriction Requirement for U.S. Appl. No. 15/148,189 dated Nov. 18, 2016.
Office Action for U.S. Appl. No. 15/148,189 dated Jan. 30, 2017.
Amendment A and Response to Office Action for U.S. Appl. No. 15/148,189 dated Apr. 25, 2017.
Office Action for U.S. Appl. No. 15/148,189 dated Jun. 26, 2017.
Amendment B and Response to Final Office Action for U.S. Appl. No. 15/148,189 dated Aug. 11, 2017.
Notice of Allowance and Fee(s) Due for U.S. Appl. No. 15/148,189 dated Aug. 18, 2017.
Corrected Notice of Allowability for U.S. Appl. No. 15/148,189 dated Oct. 26, 2017.
Issue Fee Transmittal for U.S. Appl. No. 15/148,189 dated Nov. 14, 2017.
Issue Notification for U.S. Appl. No. 15/148,189 dated Nov. 29, 2017.
Supplementary European Search Report for EP 16 79 0144 dated Dec. 6, 2018.
Office Action for Chinese Application No. 201580027315.8 dated Jan. 4, 2019, with brief description in English.
Office Action for U.S. Appl. No. 15/811,824 dated Feb. 23, 2018.
Response to Restriction Requirement for U.S. Appl. No. 15/811,824 dated Mar. 21, 2018.
Office Action for U.S. Appl. No. 15/811,824 dated Apr. 25, 2018.
Amendment A and Response to Office Action for U.S. Appl. No. 15/811,824 dated Jun. 14, 2018.
Office Action for U.S. Appl. No. 15/811,824 dated Sep. 11, 2018.
Amendment B and Response to Office Action for U.S. Appl. No. 15/811,824 dated Nov. 1, 2018.
Notice of Allowance and Fee(s) Due for U.S. Appl. No. 15/811,824 dated Nov. 8, 2018.
Corrected Notice of Allowability for U.S. Appl. No. 15/811,824 dated Jan. 17, 2019.
Issue Fee Transmittal Form for U.S. Appl. No. 15/811,824 dated Feb. 1, 2019.
Issue Notification for U.S. Appl. No. 15/811,824 dated Feb. 27, 2019.

CARTON WITH HANDLE

CROSS-REFERENCE TO RELATED APPLICATIONS

This application is a continuation of U.S. patent application Ser. No. 15/811,824, filed Nov. 14, 2017, which is a division of U.S. application Ser. No. 15/148,189, filed May 6, 2016, now U.S. Pat. No. 9,845,182, which claims the benefit of U.S. Provisional Patent Application No. 62/179,446, filed on May 7, 2015.

INCORPORATION BY REFERENCE

The disclosures of U.S. patent application Ser. No. 15/811,824, which was filed on Nov. 14, 2017, U.S. patent application Ser. No. 15/148,189, which was filed on May 6, 2016, U.S. Provisional Patent Application No. 62/179,446, which was filed on May 7, 2015, U.S. Provisional Patent Application No. 61/997,147, which was filed on May 22, 2014, U.S. Provisional Patent Application No. 61/855,819, which was filed on May 24, 2013, U.S. Provisional Patent Application No. 61/956,388, which was filed Jun. 7, 2013, and U.S. patent application Ser. No. 14/286,343, which was filed May 23, 2014, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to handles for cartons configured to receive articles in a nested arrangement.

SUMMARY OF THE DISCLOSURE

In general, one aspect of the disclosure is directed to a package comprising a carton and a plurality of articles. The carton can comprise a plurality of panels that extends at least partially around an interior of the carton. The plurality of articles can be arranged in a plurality of rows of articles in the interior of the carton, the plurality of rows of articles can comprise at least a first row and a second row, and the first row can comprise at least one more article than the second row forming a void between a first article at an end of the first row and a second article at an end of the second row. A handle can comprise the first article at the end of the first row and a handle feature extending in the carton. The handle feature can be at least partially aligned with the void and can be proximate the first article at the end of the first row.

In another aspect, the disclosure is generally directed to a method of forming a carton for containing a plurality of articles. The method can comprise obtaining a blank comprising a plurality of panels and a handle feature, forming an interior of a carton at least partially defined by the plurality of panels, and arranging a plurality of articles in a plurality of rows of articles in the interior of the carton. The plurality of rows of articles can comprise at least a first row and a second row, and the first row can comprise at least one more article than the second row forming a void between a first article at an end of the first row and a second article at an end of the second row. The method further can comprise forming a handle from the handle feature and the first article at the end of the first row. The forming the handle can comprise at least partially aligning the handle feature with the void to be proximate the first article at the end of the first row.

In another aspect, the disclosure is generally directed to a carton for containing a plurality of articles arranged in a plurality of rows of articles comprising at least a first row and a second row, the first row having at least one more article than the second row forming a void between a first article at an end of the first row and a second article at an end of the second row. The carton can comprise a plurality of panels that extends at least partially around an interior of the carton for containing the plurality of articles and a handle feature extending in the carton for forming a handle. The handle can be positioned for grasping at least the first article at the end of the first row. The handle feature can be at least partially aligned with the void and can be proximate the first article at the end of the first row.

In another aspect, the disclosure is generally directed to a blank for forming a carton for holding a plurality of articles arranged in a plurality of rows of articles comprising at least a first row and a second row, the first row having at least one more article than the second row forming a void between a first article at an end of the first row and a second article at an end of the second row. The blank can comprise a plurality of panels and a handle feature extending in the blank for forming a handle when the carton is formed from the blank. The handle can be positioned for grasping at least the first article at the end of the first row when the carton is formed from the blank. The handle feature can be at least partially aligned with the void and can be proximate the first article at the end of the first row when the carton is formed from the blank.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENT

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles or aluminum cans) as disposed within the carton embodiments. In this specification, the terms "inner," "outer," "lower," "bottom," "upper," and "top" indicate orientations determined in relation to fully erected and upright cartons.

Figure 1:
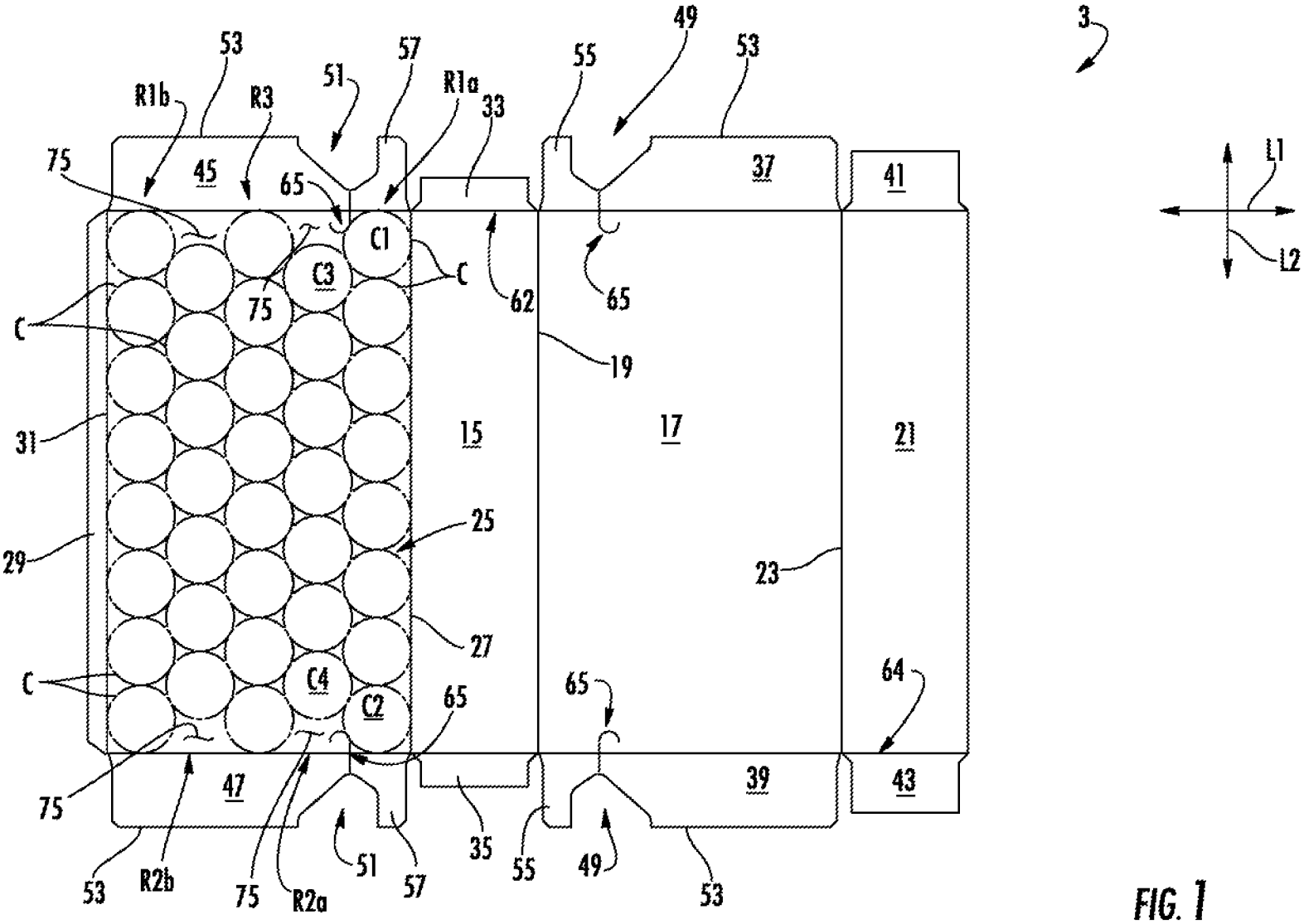
FIG. 1 is a plan view of a blank for forming a carton according to a first embodiment of the disclosure.
Figure 4A:
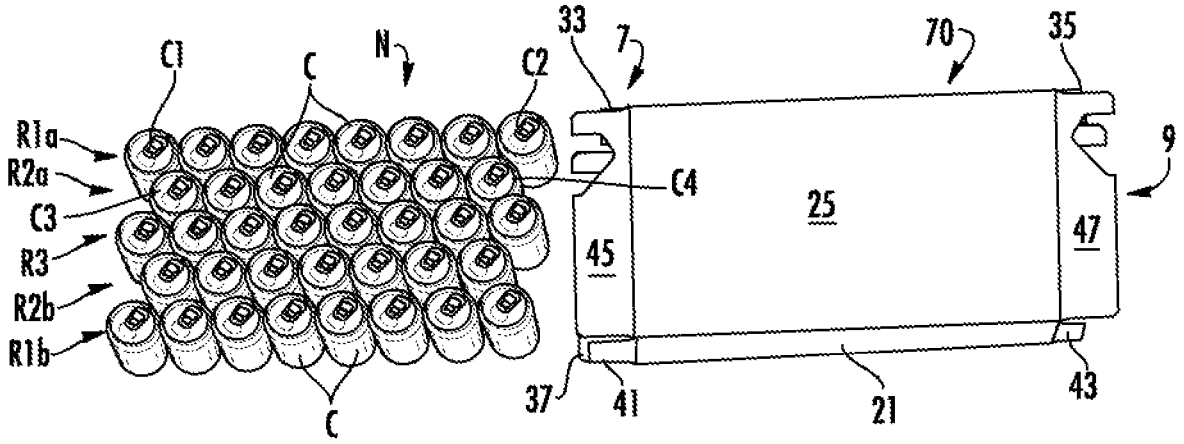
FIGS. 4A-5 are perspective views showing the loading of containers in a nested arrangement into the open-ended sleeve of FIGS. 3A and 3B according to the first embodiment of the disclosure.
Figure 4B:
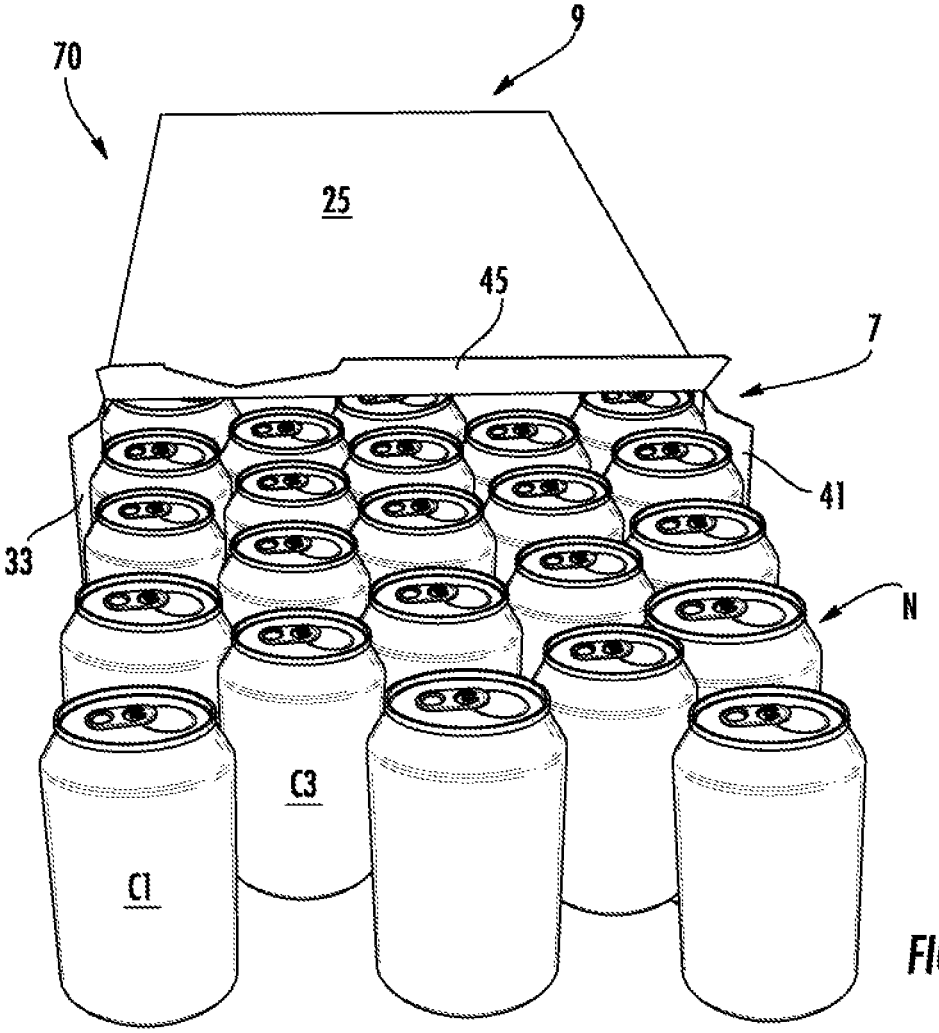
Figure 5:
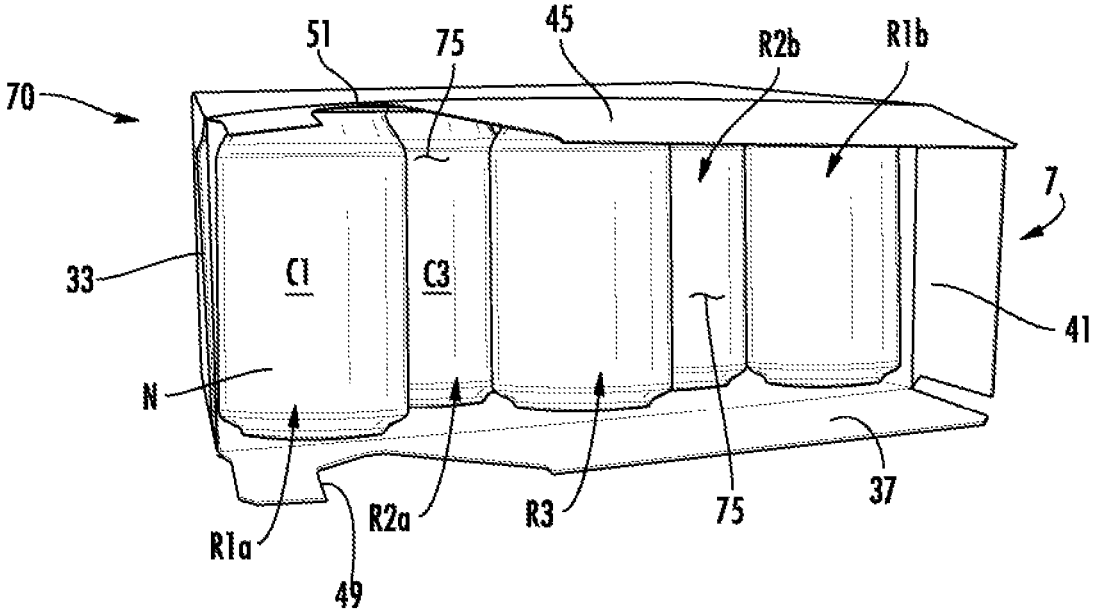
Figure 6:
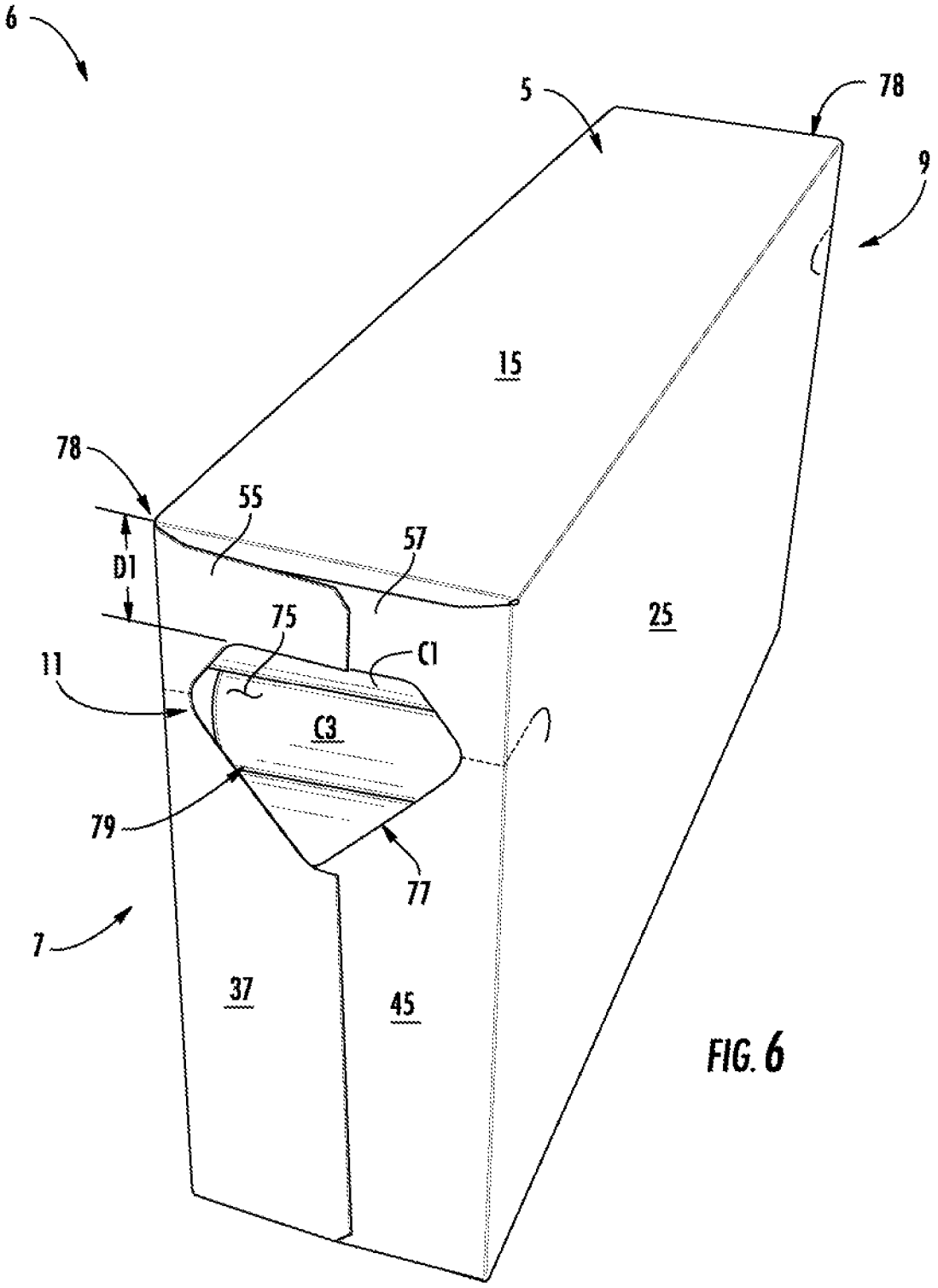
FIG. 6 is a perspective view of a package including the erected carton according to the first embodiment of the disclosure.
Figure 21:
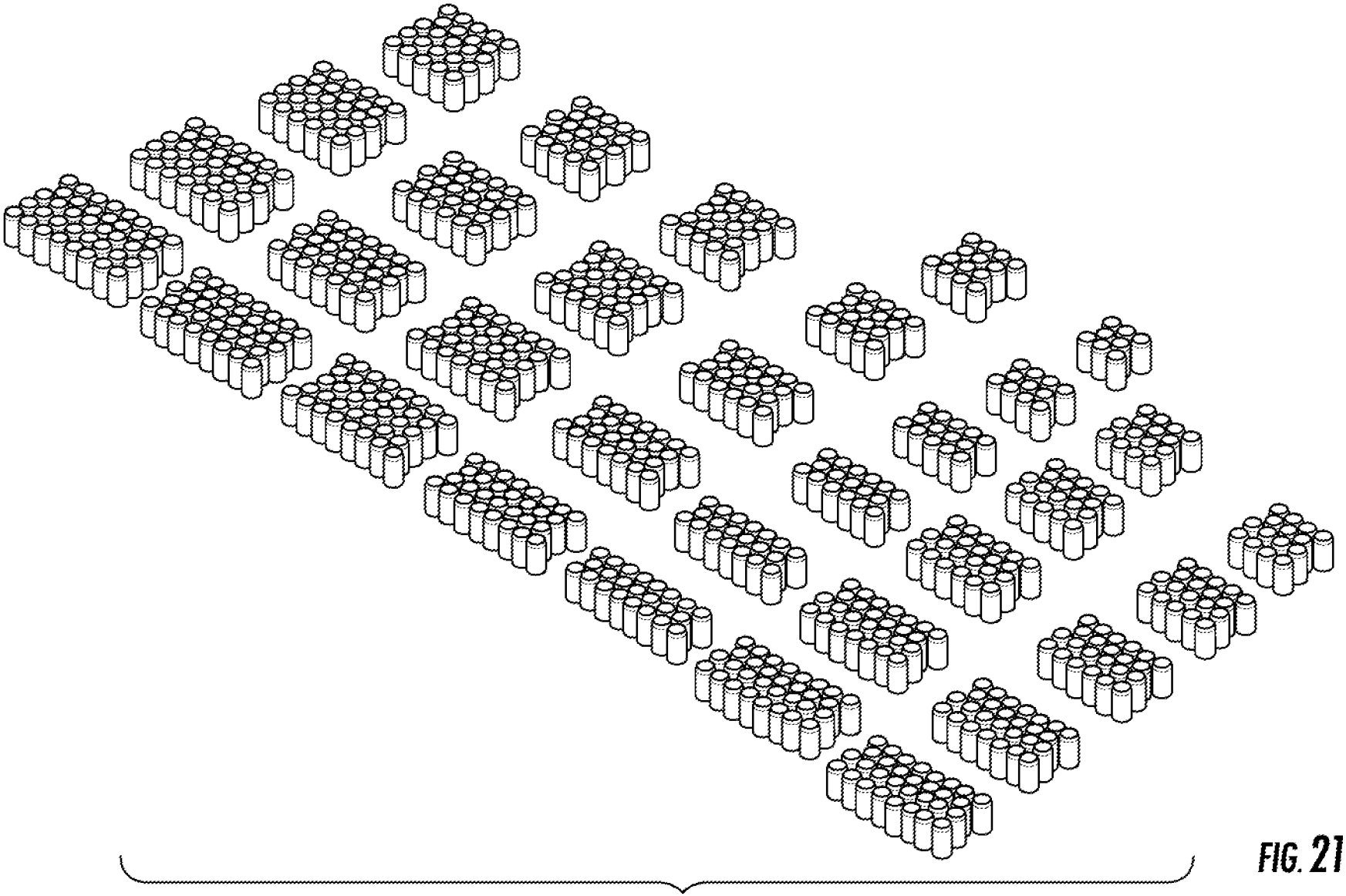
FIGS. 21 and 22 show various perspective views of article arrangements that can be used with various embodiments of the disclosure or alternative embodiments of the disclosure.
Figure 22:
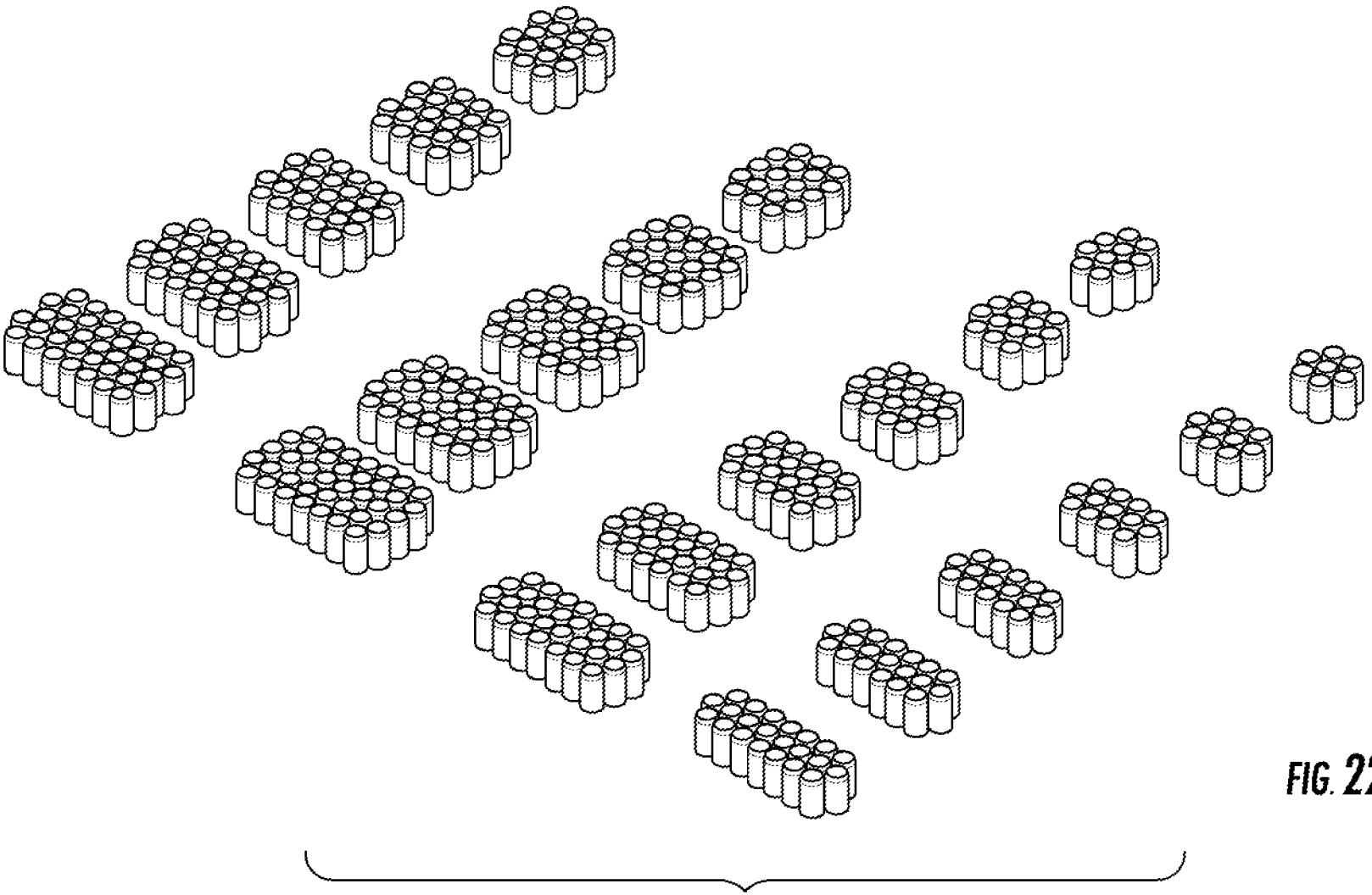

FIG. 1 is a plan view of the exterior side 1 of a blank, generally indicated at 3, used to form a carton 5 (FIG. 6) according to the first exemplary embodiment of the disclosure. The carton 5 can be used to house a plurality of articles such as containers C (e.g., in the form of beverage cans; FIGS. 4A-5) so that the carton 5 and the containers C form a package 6 (FIG. 6). In the first embodiment, the carton 5 is sized and configured to contain 38 containers C in a single layer in a "nested" (e.g., an "internal" or "inverted" nested) arrangement having two outer rows R1*a*, R1*b* of eight cans per row, two inner rows R2*a*, R2*b* of seven cans per row, and a central row R3 of eight containers per row. For example, in the illustrated embodiment, the carton 5 is sized to house thirty eight containers C in a single layer in a 8-7-8-7-8 nested arrangement, but it is understood that the carton 5 may be sized and shaped to hold containers of a different or same quantity in more than one layer and/or in different row/column arrangements (e.g., 6-5-6-5-6, 8-7-7-8, 5-4-5, 7-7-6-7, 5-4-4-4-5, 8-8-8-7-8, 3-2-3, etc.). FIGS. 21 and 22 show various other container arrangements (e.g., internal nested arrangements and external nested arrangements) that could be used with the first embodiment or other illustrated and non-illustrated embodiments of the disclosure. For example, FIG. 21 shows various internal nested arrangements and FIG. 22 shows various external nested arrangements. In the illustrated embodiment, each row R1*a*, R1*b*, R2*a*, R2*b*, R3 is nested with a respectively adjacent row (e.g., row R2*a* is nested with rows R1*a* and R3 and row R2*b* is nested with rows R1*b* and R3). The rows R1*a*, R1*b*, R2*a*, R2*b*, R3 are shown schematically in FIG. 1 in relation to one of the side panels and in perspective in FIGS. 4A and 4B.

Whether the containers C in a carton of any of the illustrated and non-illustrated embodiments are cans or other containers (e.g., beverage bottles), the containers could be arranged in any suitable nesting or other arrangements including, but not limited to, those illustrated in FIGS. 21 and 22. In general, the internal nesting arrangements can have one or more interior rows of containers C that are generally shorter than the outer rows of containers. For example, the outer row(s) (e.g., R1*a*, R1*b*) could have one more container each than the inner row(s) (e.g., R2*a*, R2*b*) respectively nested with the outer row(s). Exemplary variations could include outer row(s) having six containers and inner row(s) having five containers, outer row(s) having four containers and inner row(s) having three containers, etc. In the alternative embodiments, the carton can be sized accordingly to accommodate the arrangement of the containers C. Other nested or non-nested arrangements of the containers C could be provided without departing from the disclosure. The carton 5 can include features for facilitating conservation of board material when housing the containers C in a nested arrangement.

In the illustrated embodiment, the carton 5 includes first and second handles 11 (FIGS. 6, 7A, 7B, 8A, and 8B) for grasping and carrying the carton at a respective first end 7 and second end 9 of the carton. As will be discussed below in more detail, the handles 11, are formed from various features in the blank 3 and other features of the package 6 formed from the blank and the containers C.

The blank 3 has a longitudinal axis L1 and a lateral axis L2. In the illustrated embodiment, the blank 3 comprises a top panel 15 foldably connected to a first side panel 17 at a first lateral fold line 19, a bottom panel 21 foldably connected to the first side panel 17 at a second lateral fold line 23, a second side panel 25 foldably connected to the top panel 15 at a third lateral fold line 27, and an attachment flap 29 foldably connected to the second side panel 15 at a fourth lateral fold line 31. Any of the top and bottom panels 15, 21 and the side panels 17, 25 could be omitted or could be otherwise shaped, arranged, and/or configured without departing from the disclosure. For example, the attachment flap 29 could be foldably connected to the bottom panel 21. Additionally, the blank 3 alternatively could include two top panels cooperating to form a top of the carton 5 or two bottom panels cooperating to form a bottom of the carton.

The top panel 15 is foldably connected to a first top end flap 33 and a second top end flap 35. The first side panel 17 is foldably connected to a first side end flap 37 and a second side end flap 39. The bottom panel 21 is foldably connected to a first bottom end flap 41 and a second bottom end flap 43. The second side panel 25 is foldably connected to a first side end flap 45 and a second side end flap 47. When the carton 5 is erected, the top and bottom end flaps 33 and 41 and side end flaps 37 and 45 close the first end 7 of the carton, and the top and bottom end flaps 35 and 43 and side end flaps 39 and 47 close the second end 9 of the carton. In accordance with an alternative embodiment of the present disclosure, different flap arrangements can be used for at least partially closing the ends 7, 9 of the carton 5.

In the illustrated embodiment, the top and bottom end flaps 33 and 41 and side end flaps 37 and 45 extend along a first marginal area of the blank 3, and are foldably connected at a first longitudinal fold line 62 that extends along the length of the blank. Also in the illustrated embodiment, the top and bottom end flaps 35 and 43 and side end flaps 39 and 47 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

Figure 1A:
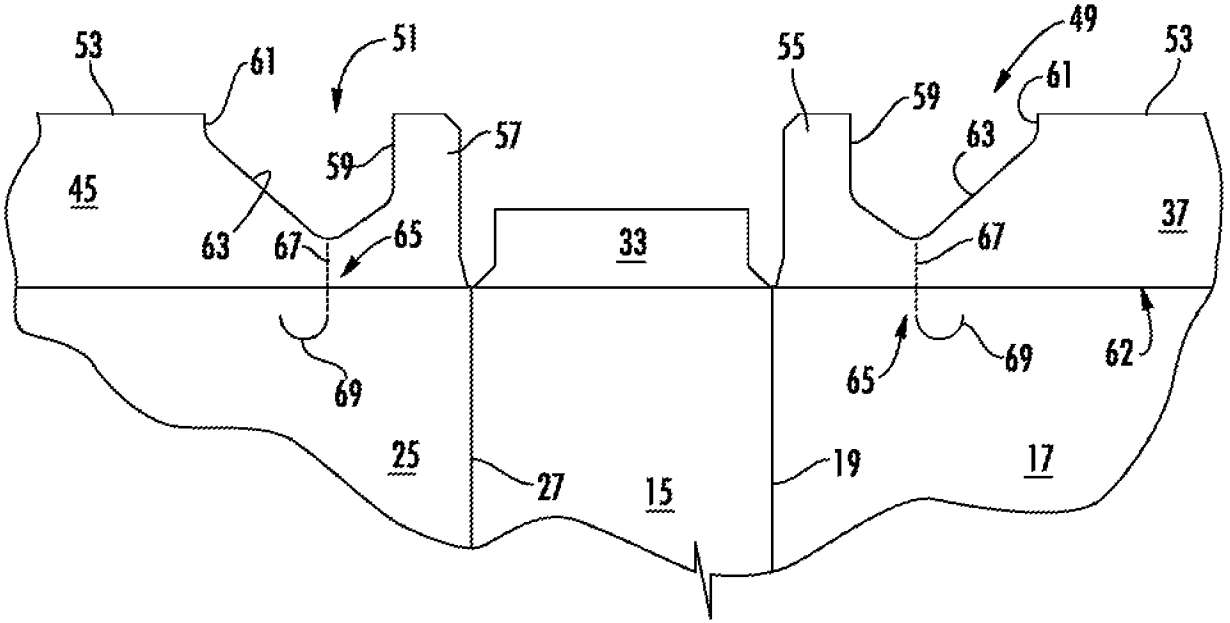
FIG. 1A is a detail view of a portion of the blank of FIG. 1.

As shown in FIGS. 1 and 1A, the features that form the handles 11 of the carton 5 include first handle notches 49 formed in respective side end flaps 37, 39 and second handle notches 51 formed in the respective side end flaps 45, 47. In the illustrated embodiment, the handle notches 49, 51 extend in a respective outer free edge 53 of the respective side end flaps 37, 39, 45, 47, wherein the outer free edges 53 generally extend in the longitudinal direction L1. Each of the side end flaps 37, 39 can include an upper extension 55 extending adjacent the respective handle notches 49, and each of the side end flaps 45, 47 can include an upper extension 57 extending adjacent the respective handle notches 51. As shown in FIGS. 1 and 1A, each of the handle notches 49, 51 can include an upper edge 59 extending along the respective upper extension 55, 57 (e.g., in a generally lateral direction L2), a lower edge 61 disposed opposite to the respective upper edge 59, and a generally V-shaped edge 63 disposed between the respective upper edge 59 and lower edge 61.

In the illustrated embodiment, a tear stop feature 65 can extend from the respective V-shaped edge 63 (e.g., from the respective vertex thereof) of each of the handle notches 49, 51. As shown in FIGS. 1 and 1A, each of the tear stop features 65 can include a generally lateral tear line 67 extending in the respective side end flap 37, 39, 45, 47 and into the respective side panel 17, 25 and an arcuate (e.g., semicircular) cut 69 extending from the end of the respective tear line 67 in the respective side panel 17, 25. In one embodiment, the tear stop features 65 can help control and/or stop tearing of the carton 5 due to stress on the handles 11, for example. One of the handles 11 could have different features than the other handle or could be omitted without departing from the disclosure. One or both of the handles 11 could be otherwise shaped, arranged, positioned, and/or configured without departing from the disclosure.

Figure 2:
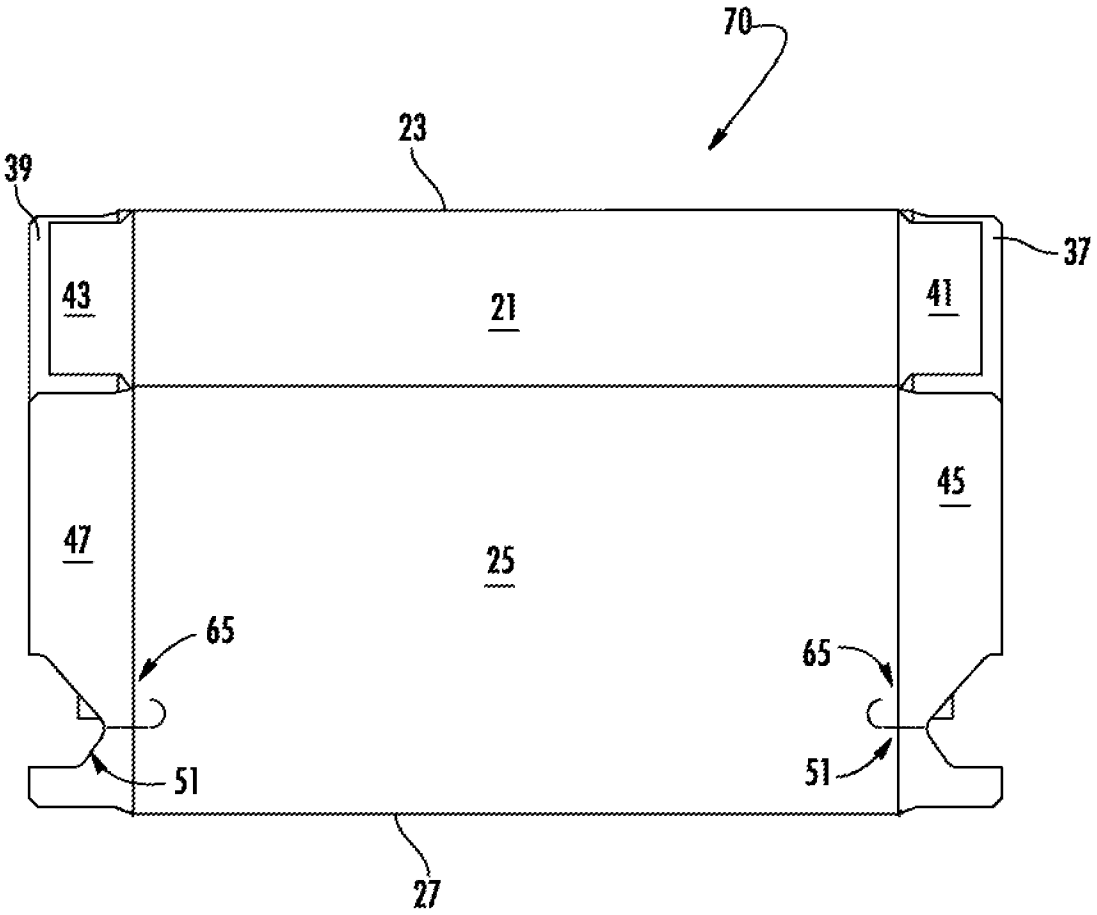
FIGS. 2-3B are perspective views showing the formation of an open-ended sleeve according to the first embodiment of the disclosure.
Figure 3A:
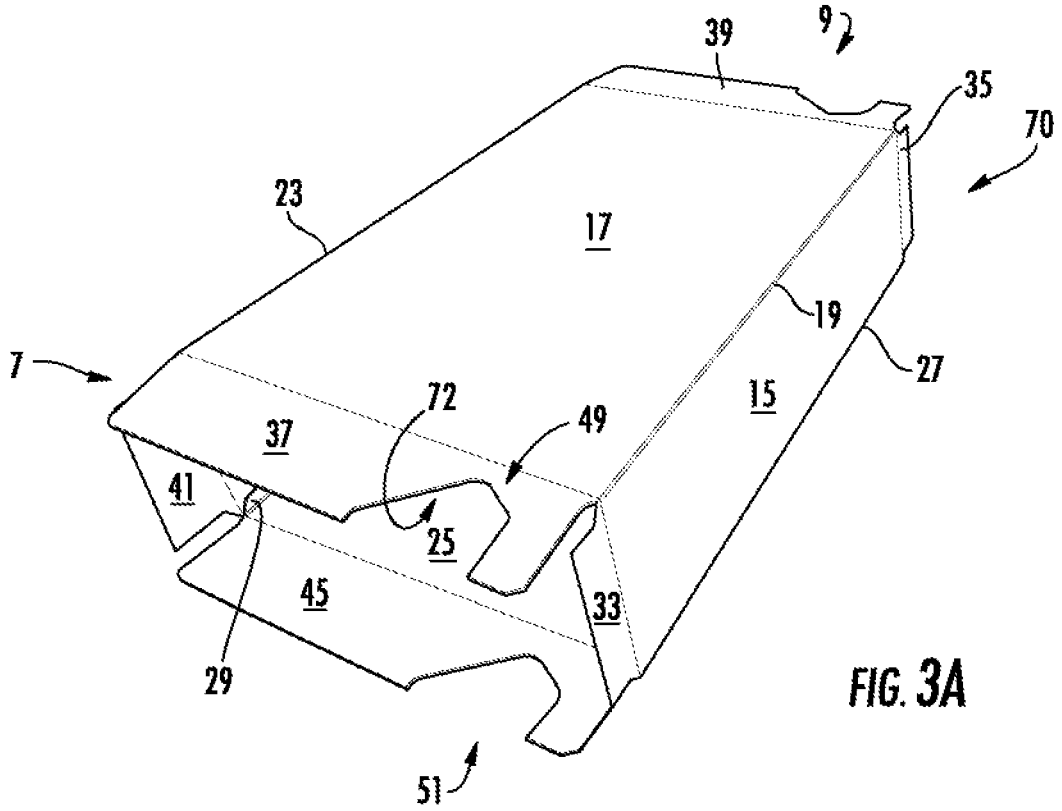
Figure 3B:
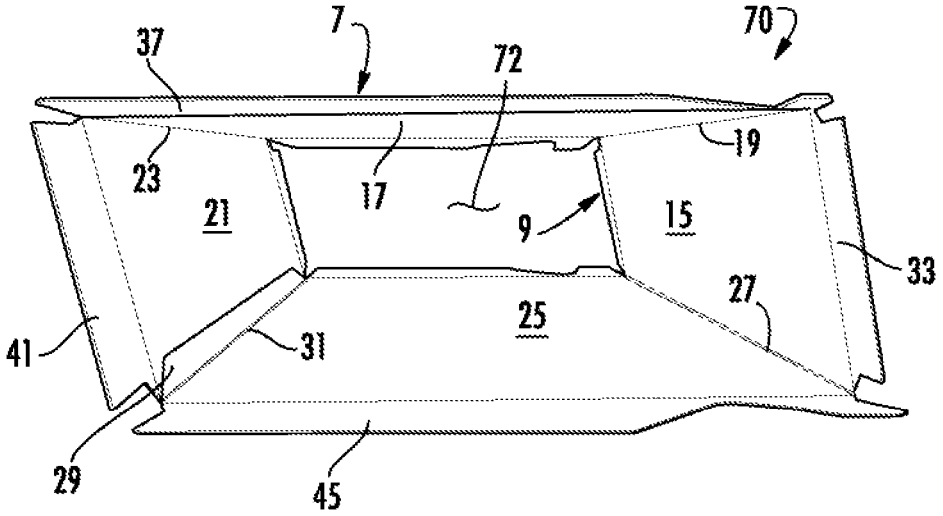

In the illustrated embodiment, the carton 5 can be erected from the blank 3 by folding the panels 15, 17, 21, 25 along the lateral fold lines 19, 23, 27, 31 and gluing the attachment flap 29 to the bottom panel 21 to form an open-ended sleeve 70 (FIGS. 3A and 3B). For example, as shown in FIG. 2, the blank 3 can be folded along the lateral fold lines 27 and 23 so that the second side panel 25 overlaps the top panel 15 and the first side panel 17, the attachment flap overlaps the first side panel 17, and the bottom panel 21 overlaps the first side panel 17 and the attachment flap 29. Accordingly, the attachment flap 29 can be glued or otherwise secured to the interior surface of the bottom panel 21. As shown in FIGS. 3A and 3B, the blank 3 can be folded along the lateral fold lines 19, 23, 27, 31 and opened into the open ended sleeve 70 with an interior 72.

As shown in FIG. 4A, the containers C can be arranged in the nested arrangement N and the nested arrangement N can then be loaded into the carton 5 as shown in FIGS. 4B and 5. Alternatively, the containers C could be arranged during or after loading into the carton 5. In one embodiment, eight containers C can be arranged in the central row R3 and fourteen containers C can be arranged in the two inner rows R2*a*, R2*b* of seven containers each so that the containers of the inner rows R2*a*, R2*b* are nested with the containers of the central row R3. Additionally, sixteen containers C can be arranged in the two outer rows R1*a*, R1*b* of eight containers each so that the containers of the outer rows R1*a*, R1*b* are nested with the containers of the respective inner rows R2*a*, R2*b*. Accordingly, the outer rows R1*a*, R1*b* and the central row R3 can extend beyond the inner rows R2*a*, R2*b* by approximately half a container width (e.g., about the length of a radius of one of the containers C) at each end of the arrangement N. For example, the outer row R1*a*, which is adjacent the top panel 15 and can be considered a top row R1*a*, can have a first end container C1 that will be disposed adjacent the first end 7 of the carton 5 (FIGS. 5-7B) and a second end container C2 that will be disposed adjacent the second end 9 of the carton. Similarly, the inner row R2*a*, which is nested with the top row R1*a* and can be considered an upper inner row R2*a*, can have a first end container C3 that will be disposed adjacent the first end 7 of the carton 5 (FIGS. 5-7B) and a second end container C4 that will be disposed adjacent the second end 9 of the carton. In the illustrated embodiment, approximately half of each of the end containers C1, C2 of the top row R1*a* extends beyond the respective end containers C3, C4 of the upper inner row R2*a*. In the illustrated embodiment, the bottom row R1*b* and the lower inner row R2*b* are similarly configured.

One or both of the ends 7, 9 of the open-ended sleeve 70 can be at least partially closed by folding the end flaps along the respective fold lines 62, 64 over the respective end 7, 9. In the illustrated embodiment, the containers C are loaded into the open-ended sleeve 70 before the ends 7, 9 are closed. Alternatively, the containers C can be loaded before or after either of the ends 7, 9 is closed. In the illustrated embodiment, the first end 7 can be closed (FIG. 6) by folding the top end flap 33 and the bottom end flap 41 along the longitudinal fold line 62 over the open first end 7 of the open-ended sleeve 70, and then the side end flaps 37, 45 can be folded along the longitudinal fold line 62 to overlap the top and bottom end flaps 33, 41. As shown in FIG. 6, the side end flap 37 can partially overlap the side end flap 45. The side end flaps 37, 45 can be glued to the top and bottom end flaps 33, 41 and/or to one another to secure the end flaps in the closed position. In an alternative embodiment, the end flaps 33, 37, 41, 45 could have different overlapping arrangements without departing from the disclosure.

The second end 9 can be closed in a similar manner as the first end 7 is closed. The package 6 including the erected carton 5 with the nested arrangement N of containers C is shown in FIG. 6. The carton 5 can be erected and/or the ends 71, 73 could be closed by other forming or folding steps as described herein without departing from the disclosure.

Since each of the inner rows R2*a*, R2*b* include one fewer container C than each of the outer rows R1*a*, R1*b* and the central row R3, the inner rows R2*a*, R2*b* are spaced apart from each of the ends 7, 9 and each of the fold lines 62, 64 (FIGS. 1 and 5-8B). Accordingly, there is a void 75 between each of the inner rows R2*a*, R2*b* and the carton 5. For example, as shown in FIGS. 6-8B, a void is formed and defined by the end container C1 of the top row R1*a*, the end container C3 of the upper inner row R2*a*, the end container of the central row R3, and the overlapped end flaps (e.g., the side end flaps 37, 45) of the first closed end 7.

Figure 7A:
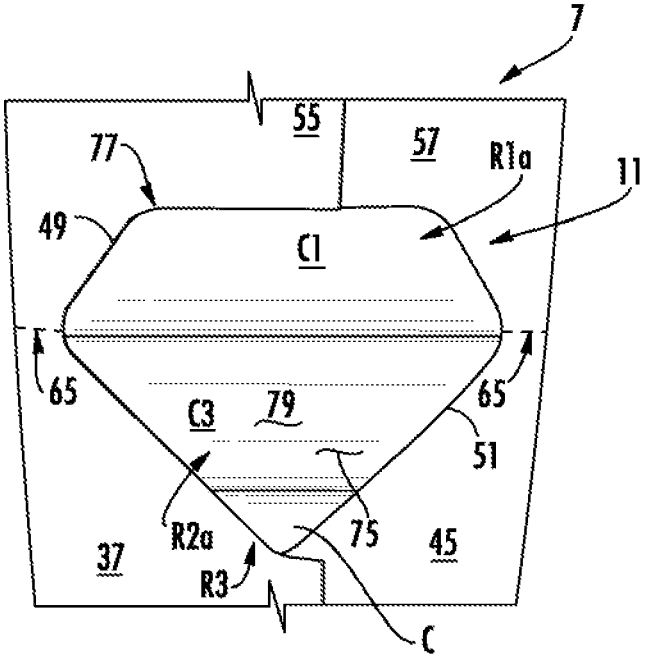
FIGS. 7A and 7B are perspective views of the handle of the package of FIG. 6.
Figure 7B:
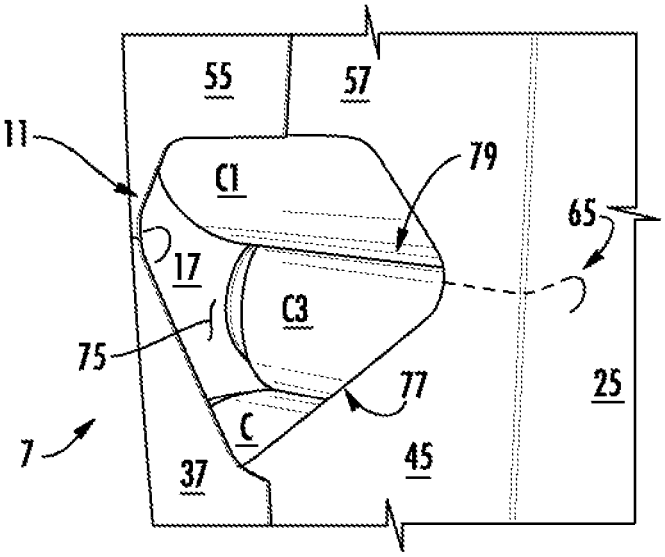

In the illustrated embodiment, the handles 11 are formed in each end 7, 9 when the containers C are loaded into the carton 5 and the ends are closed to form the package 6. For example, as shown in FIGS. 6-7B, the handle notches 49, 51 of the respective side end flaps 37, 45 are aligned in the closed end 7 to form a handle opening 77 adjacent to and in communication with the void 75 at the end of the upper inner row R2*a*. Generally, the handle notches 49, 51 and/or the handle opening comprise a handle feature extending in the carton 5. The upper extensions 55, 57 and the top end flap 33 are partially overlapped above the handle opening 77 to help retain the container C1, and the top end flap 33 can reinforce the upper extensions 55, 57 to reinforce the handle 11. In the illustrated embodiment, the handle opening 77 extends upwardly far enough to partially expose the container C1 in the top row R1*a*. However, in an alternative embodiment, the handle opening 77 could be entirely below the container C1 and the top row R1*a* for example. Stated another way, the upper edges 59 of the handle notches 49, 51 can be spaced apart from the top panel 15 at least a distance D1 (FIG. 6), which can be approximately half the width of a container C (e.g., the radius of a container C). Alternatively, the distance D1 could be more or less than half the width of a container C.

Figure 8A:
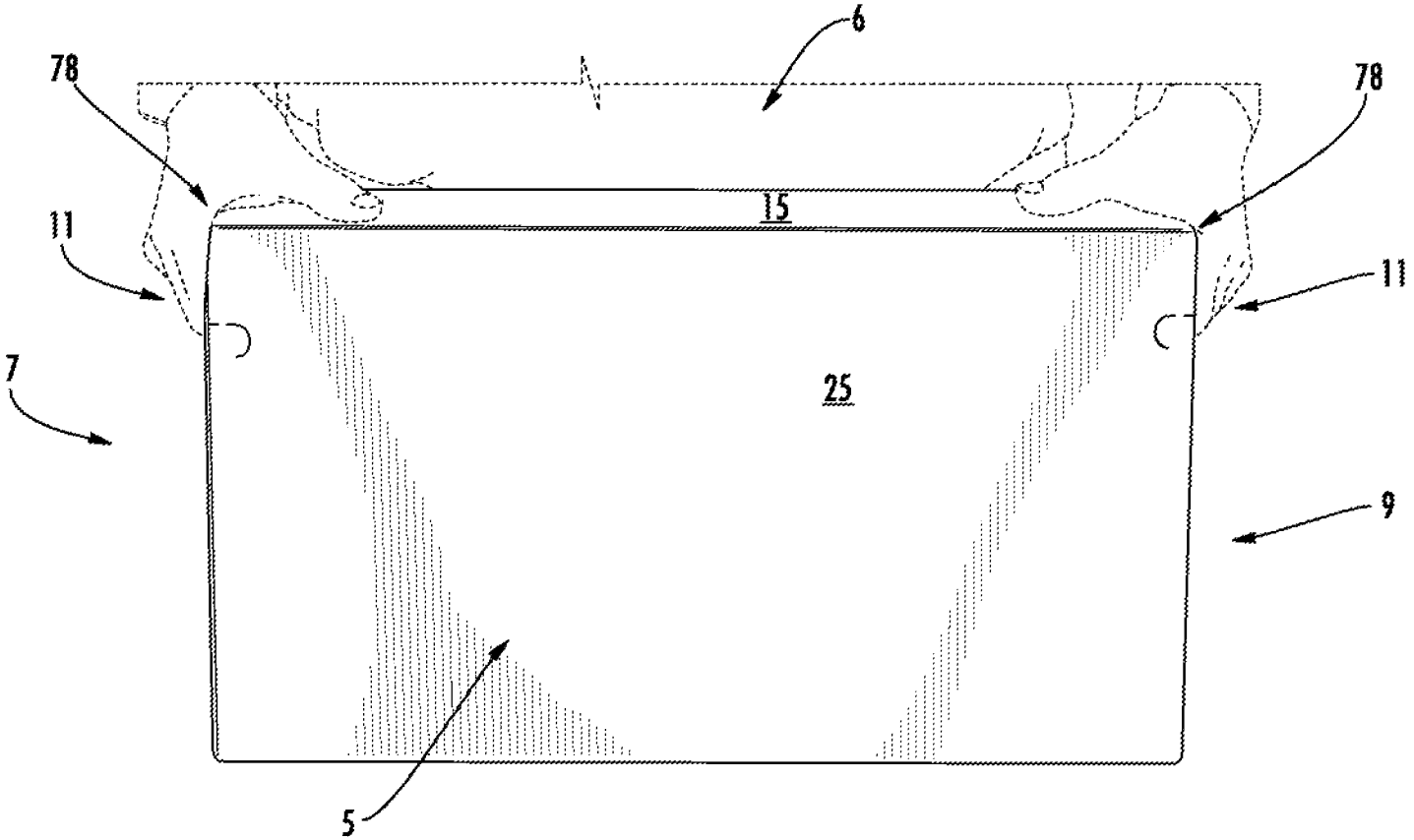
FIGS. 8A and 8B are perspective views of the handles of the package of FIGS. 6-7B being grasped by a user according to the first embodiment of the disclosure.
Figure 8B:
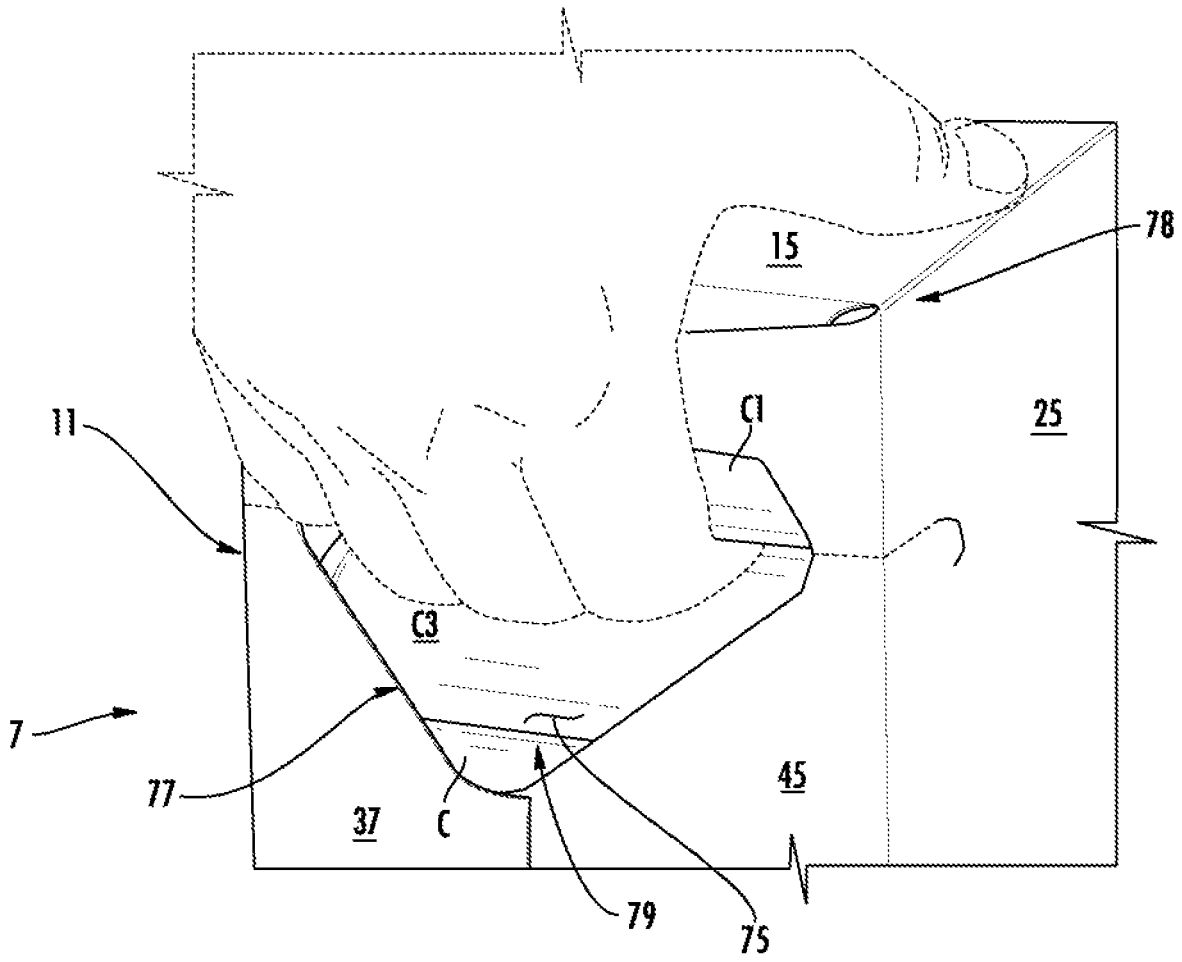

In the illustrated embodiment, the handle 11 includes the handle feature in the carton (e.g., the handle opening 77) and the container C1. For example, as shown in FIGS. 8A and 8B, a user can reach into the interior 79 of the carton 5 through the handle opening 77, wherein the void 75 provides space for the user's hand adjacent the container C3 of the upper inner row R2*a* and above the end container of the central row R3. The user can then grasp the container C1 of the top row R1*a* through the handle opening 77. The handle 11 in the second closed end 9 is similarly configured, and the user can also grasp the container C2 at the opposite end of the top row R1*a* from the container C1. Accordingly, the user can grasp the end containers C1, C2 of the top row R1*a* via the respective handle openings 77 at the respective ends 7, 9 to lift and/or carry and/or hold the carton 5 (FIG. 8A). In addition, as shown in FIGS. 8A and 8B, the user's hands can engage the top panel 15, the side panel 17, and/or the side panel 25 at the upper corners 78 of the carton 5 adjacent the handles 11. The handles 11 and/or any other features of the carton 5 could be otherwise shaped, arranged, positioned, and/or configured without departing from the disclosure. For example, one of the handles 11 could be omitted.

In the illustrated embodiment, since the end containers C1, C2 of the top row R1*a* are part of the handles 11, and the end containers C1, C2 are grasped when the carton 5 is carried at the handles 11, the weight of the carton 5 and the containers C therein is distributed not only to the end flaps adjacent the handles 11, but also to the other panels of the carton (e.g., the top panel 15) and/or to the nested containers C by the grasped end containers C1, C2. For example, grasping the containers C1, C2 at the handles 11 can distribute the weight of the package (including the carton 5 and the containers C) around the upper corners 78 of the carton 5 above the handles 11. Accordingly, the caliper of the carton material can be lower than would otherwise be required for a carton having the same number of containers C in one embodiment. For example, a package according to the first embodiment and/or other embodiments with 38 containers C and the handles 11 could include a carton made from 18 pt paperboard, whereas an 18 pt carton might otherwise be used for a package with 12 containers C. Additionally, since the handles 11 are formed from features that are already part of the package (e.g., the end flaps and the containers), the handles 11 provide a strong, reliable way to carry the package without necessarily adding more expensive handle features (e.g., reinforcing tape, additional paperboard, handles made from other materials (e.g., reinforced plastic), etc.). The voids 75 adjacent the handles 11 provide room for a user's hands to grasp the end containers C1, C2.

In an alternative embodiment, one or both of the handles 11 could be disposed lower in the ends 7, 9 of the carton 5 to be aligned with the voids 75 defined between the end containers of the bottom row R1*b*, the lower inner row R2*b*, and the central row R3 so that the end container of the central row R3 and/or the bottom row R1*b* can be grasped as part of the handles. In a further alternative, the handle features could be disposed in the ends of the carton to accommodate a different nesting arrangement, such as an external nesting arrangement (e.g., see FIG. 22). For example, the handles could be configured for a carton with an external nesting arrangement wherein the top row is shorter than the upper inner row (e.g., a 6×7×6×7×6 arrangement). The central row could also be shorter than the upper inner row so that a void is disposed below the end container of the upper inner row. The handle feature could be lower in the closed end of the carton to be aligned with the void at the end of the shorter central row so that a user can grasp the end container of the upper inner row as part of the handle. Generally, in one embodiment, the handle features of the carton could be located anywhere one row is shorter than another so the container at the end of the longer row can be grasped adjacent a void.

Figure 9:
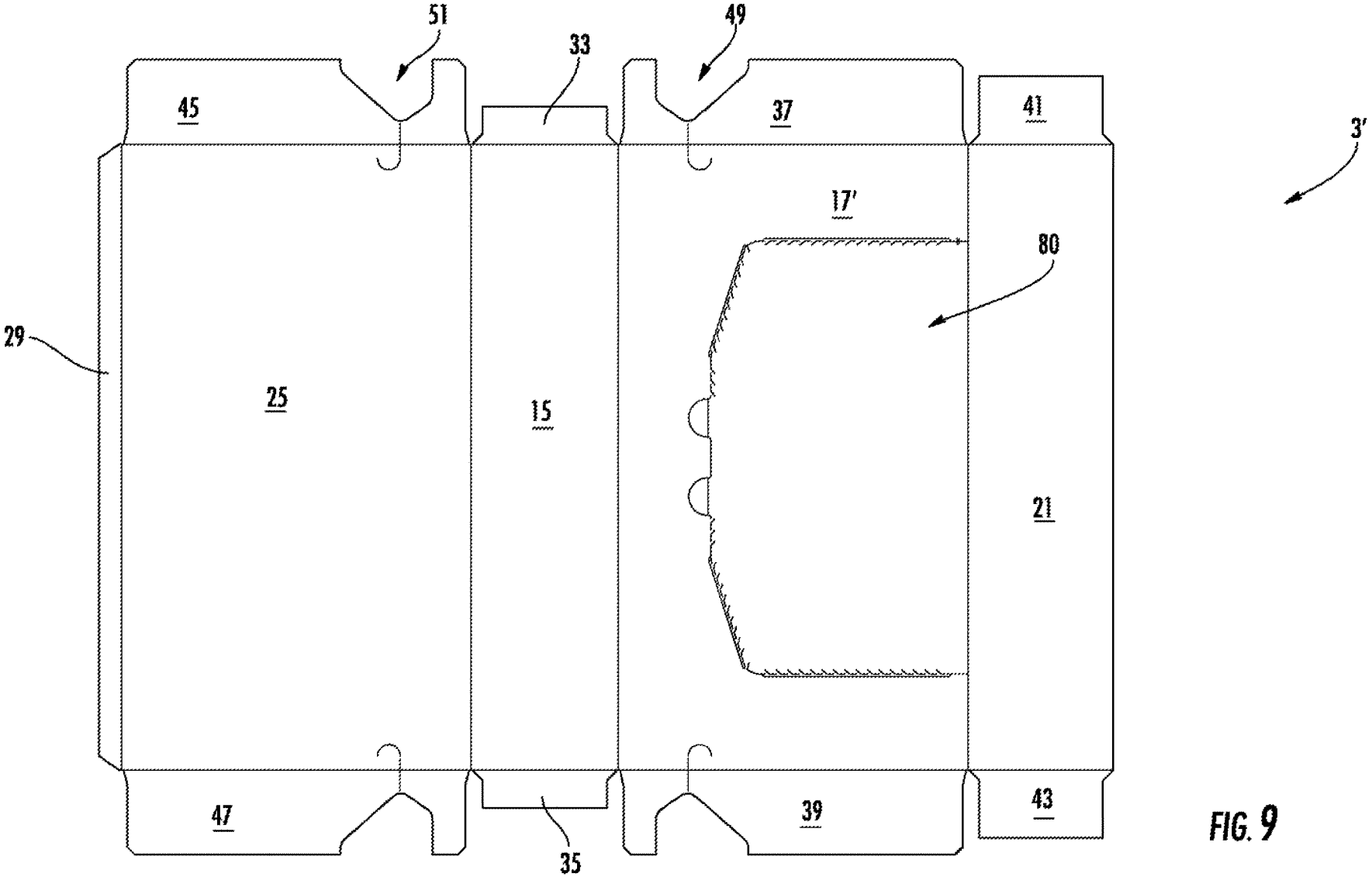
FIG. 9 is a plan view of an alternative embodiment of the blank of FIG. 1 with a dispenser feature.

An alternative embodiment of the blank 3 is shown in FIG. 9, wherein the blank 3' is shown with an optional dispenser feature 80 defined by a tear line in the first side panel 17' for providing access to the containers C in the carton formed from the blank 3'. The dispenser feature 80 could be otherwise shaped, arranged, positioned, and/or configured without departing from the disclosure.

Figure 10:
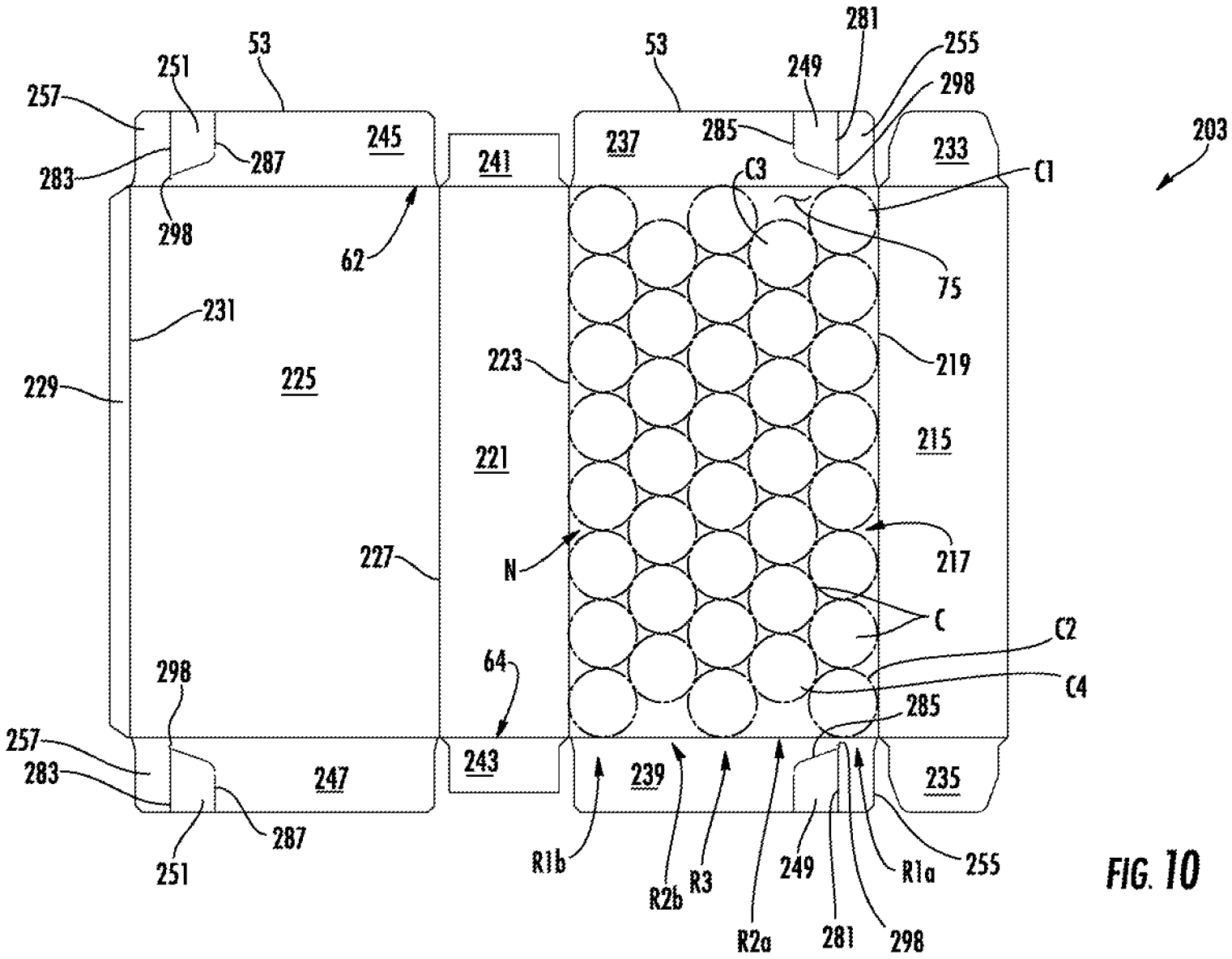
FIG. 10 is a plan view of a blank for forming a carton according to a second embodiment of the disclosure.

FIG. 10 is a plan view of a blank 203 for forming a carton 205 and a package 406 (FIGS. 11 and 12) of a second embodiment of the disclosure. The second embodiment is generally similar to the first embodiment, except for variations noted and variations that will be apparent to one of ordinary skill in the art. Accordingly, similar or identical features of the embodiments have been given like or similar reference numbers. As shown in FIG. 10, the top panel 215 is foldably connected to the first side panel 217 along the lateral fold line 219, and the bottom panel 221 is foldably connected to each of the first side panel 217 and the second side panel 225 along respective lateral fold lines 223, 227. The attachment flap 229 is foldably connected to the second side panel 225 along a lateral fold line 231. The top end flap 233, the side end flaps 237, 245, and the bottom end flap 241 are foldably connected to the respective top panel 215, side panels 217, 225, and bottom panel 221 along the longitudinal fold line 62, and the top end flap 235, the side end flaps 239, 247, and the bottom end flap 243 are foldably connected to the respective top panel 215, side panels 217, 225, and bottom panel 221 along the longitudinal fold line 64.

When the carton 205 is formed and loaded with containers C in a nested arrangement N (e.g., similarly or identically to the carton 5 of the first embodiment), the attachment flap 229 is secured (e.g., glued) to the interior surface of the top panel 215. The package 206 including the erected carton 205 with the nested arrangement N of containers C is shown in at least FIGS. 11 and 12. The blank 203 could be otherwise shaped, arranged, and/or configured without departing from the disclosure. The carton 205 could be otherwise formed and/or loaded without departing from the disclosure.

In the second embodiment, the handle features of the blank 203 include a handle flap portion 249 in each of the side end flaps 237, 239 and a handle flap portion 251 in each of the side end flaps 245, 247 instead of the handle notches 49, 51 of the first embodiment. Each of the handle flap portions 249 is foldably connected to the respective side end flap 237, 239 along a respective fold line 281, and each of the handle flap portions 251 is foldably connected to the respective side end flap 245, 247 along a respective fold line 283. Accordingly, the upper extensions 255, 257 are generally defined between the fold lines 281, 283 and a laterally-extending edge of the respective side end flaps 237, 239, 245, 247. Each of the handle flap portions 249 can be separable from the respective side end flap 237, 239 along a respective tear line 285, and each of the handle flap portions 251 can be separable from the respective side end flap 245, 247 along a respective tear line 287. Alternatively the handle flap portions could be separable from the side end flaps along cut lines and/or cuts with spaced nicks, for example. In the illustrated embodiment, each of the tear lines 285, 287 can terminate at a respective hook-shaped tear stop 298 adjacent the respective fold line 281, 283.

As shown in FIG. 10, the top end flaps 233, 235 extend farther in the lateral L2 direction than the width of the upper extensions 255, 257 in the longitudinal L1 direction so that portions of the top end flaps 233, 235 are overlapped by the handle flap portions 249, 251 at the respective ends 207, 209 when the carton 205 is formed. The handle features could be otherwise shaped, arranged, positioned, and/or configured without departing from the disclosure.

Figure 11:
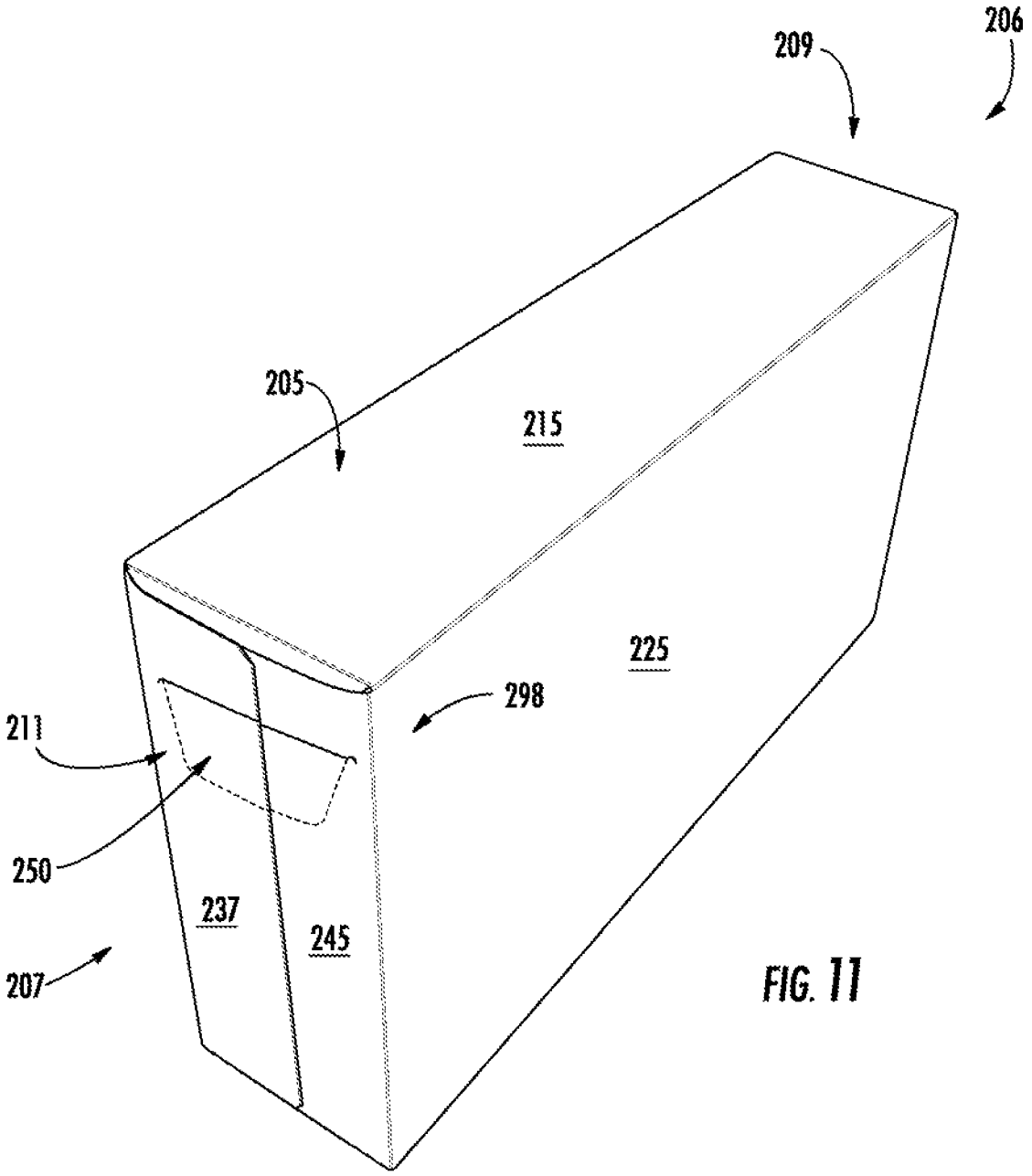
FIG. 11 is a perspective view of a package including the erected carton according to the second embodiment of the disclosure.
Figure 12:
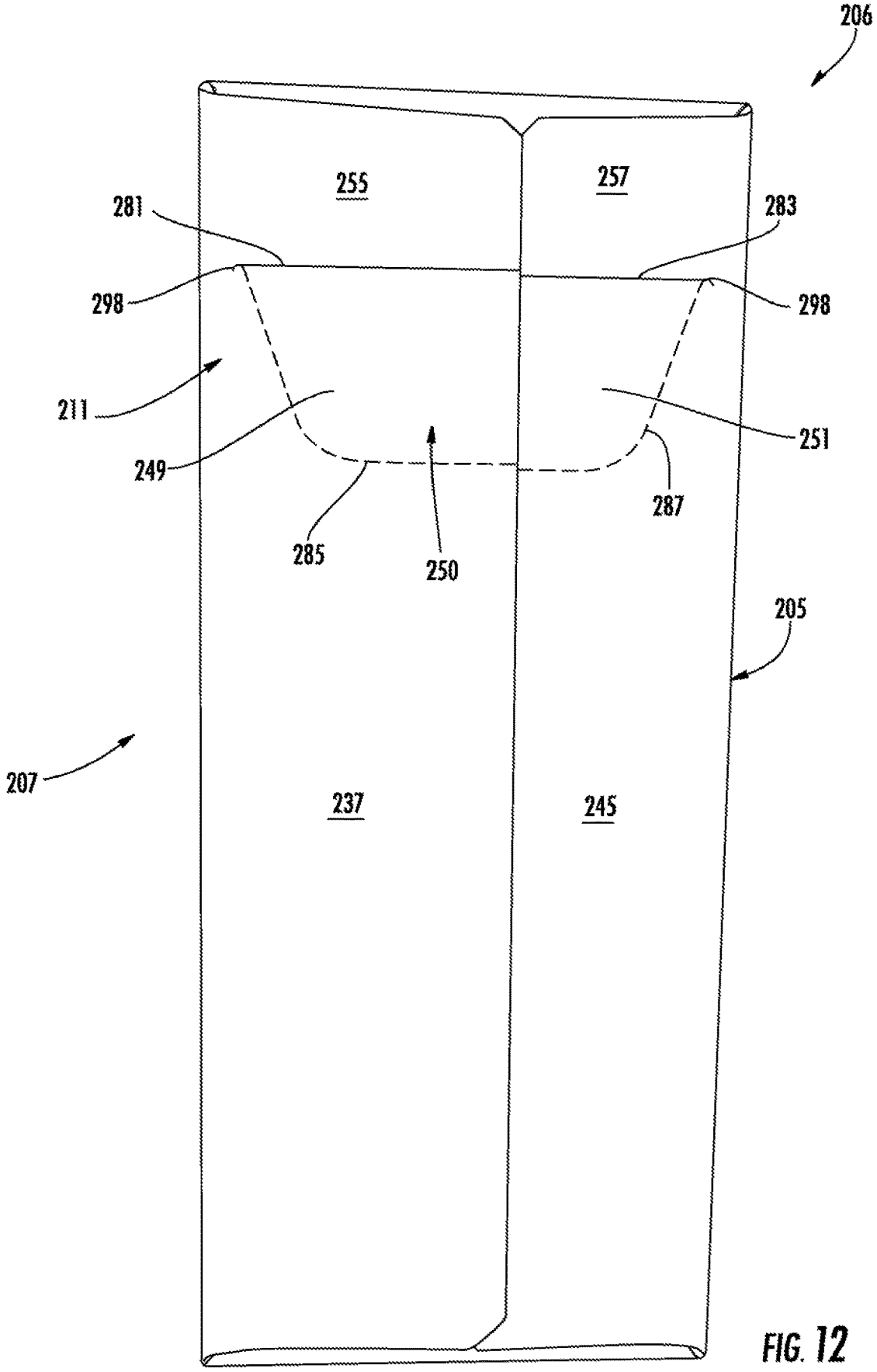
FIG. 12 is an end view of the package of FIG. 11.
Figure 13A:
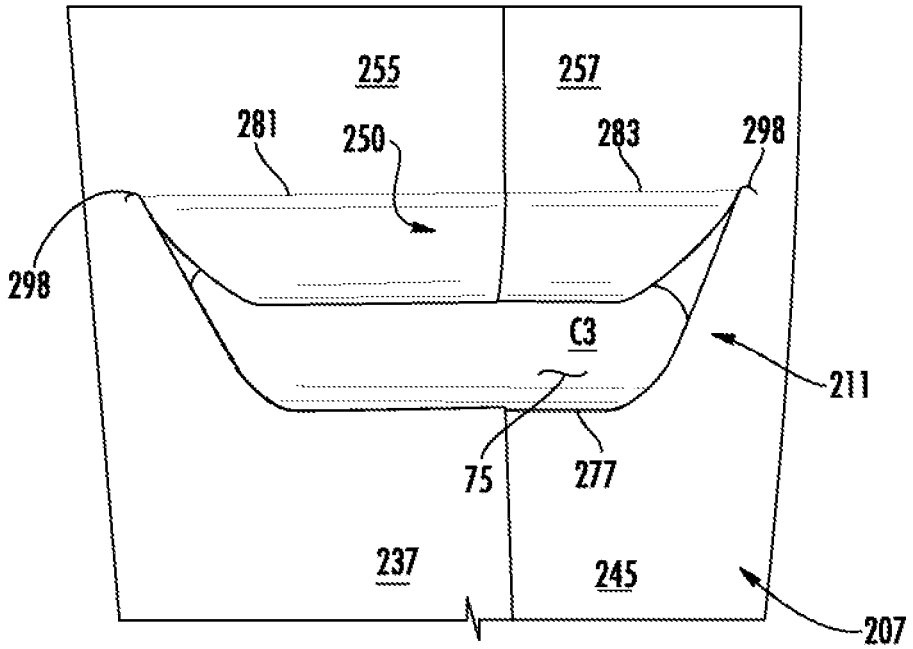
FIGS. 13A and 13B are perspective views of the handle of the package of FIGS. 11 and 12.
Figure 13B:
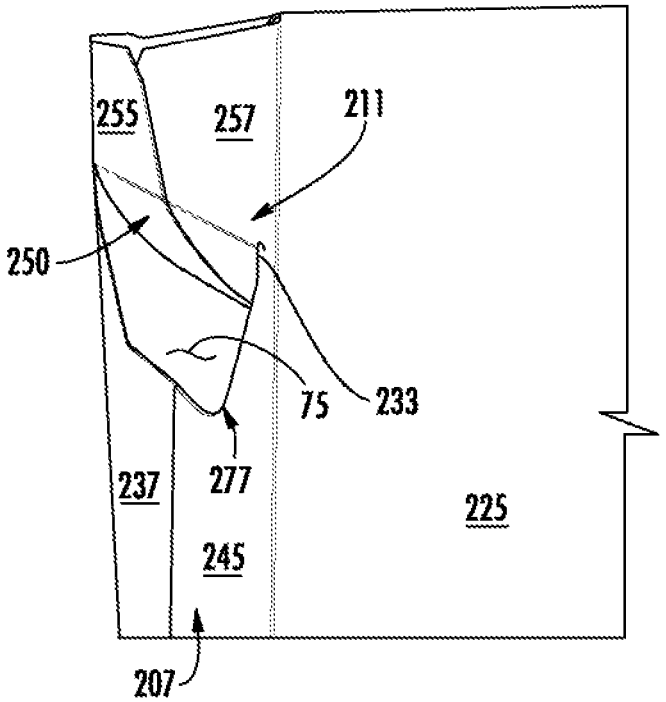
Figure 14A:
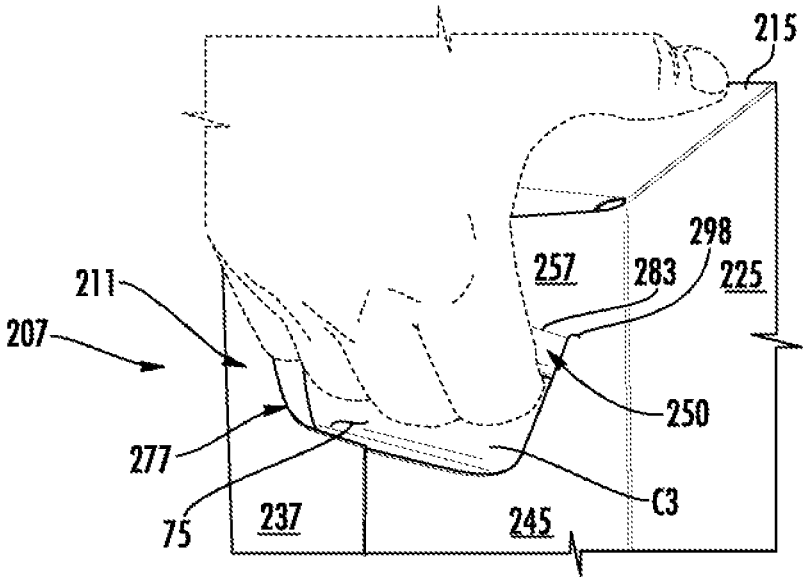
FIGS. 14A and 14B are perspective views of the handles of the package of FIGS. 11 and 12 being grasped by a user according to the second embodiment of the disclosure.
Figure 14B:
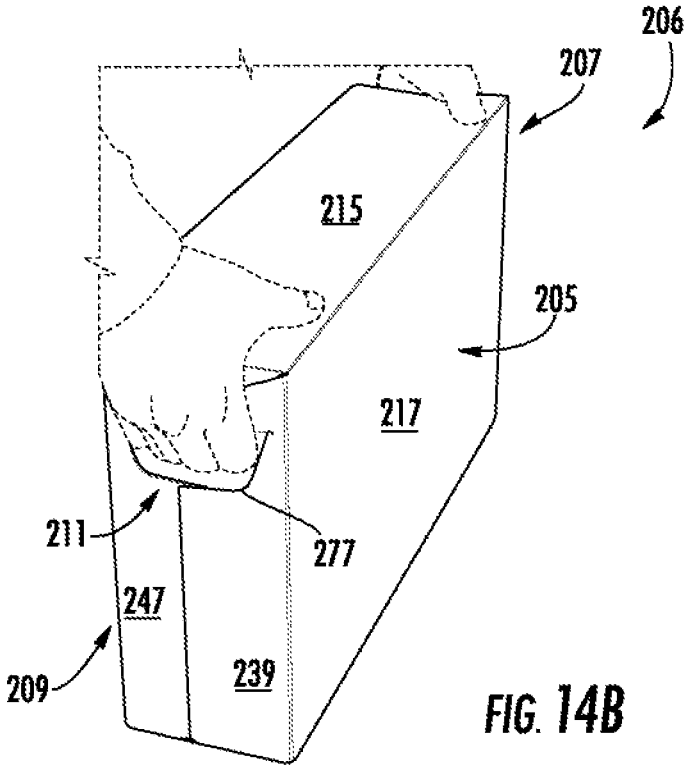

As shown in FIGS. 11 and 12, each of the handles 211 includes a handle flap 250 formed by the overlapped handle flap portions 249, 251 at each end 207, 209 of the carton 205. In the illustrated embodiment, the handle flap 250 at the first end 207 overlaps a lower portion of the top end flap 233 and is generally aligned with the void 75 below the end container C1 of the top row R1*a*. The handle flap 250 at the second end 209 is similarly configured. In one embodiment, the handle flap 250, the handle flap portions 249, 251, and/or the lower portions of the top end flaps 233, 235 can comprise a handle feature in the carton 205. For each of the handles 211, the handle flaps 250 can be separated from the respective side end flaps along the tear lines 285, 287 and folded along the fold lines 281, 283 into the void 75. Accordingly, a user can push the handle flaps 250 (and the overlapped top end flaps 233, 235) into the respective voids 75 at each of the carton 205 (FIGS. 13A and 13B), at least partially insert their hands into the respective voids 75 via the respective handle openings 277 formed by folding the handle flaps 250 inwardly (FIG. 14A), and grasp the end containers C1, C2 at opposite ends of the top row R1*a* to lift, carry, and/or hold the carton 205 (FIG. 14B). The handle flaps 250 can extend at least partially between the user's hands and the end containers C1, C2 of the top row R1*a* to help reduce heat transfer between the user's hands and the containers C, for example. The handles 211, the carton 205, and/or the package 206 could be otherwise shaped, arranged, and/or configured without departing from the disclosure. For example, one of the handles 211 could be omitted.

Figure 15:
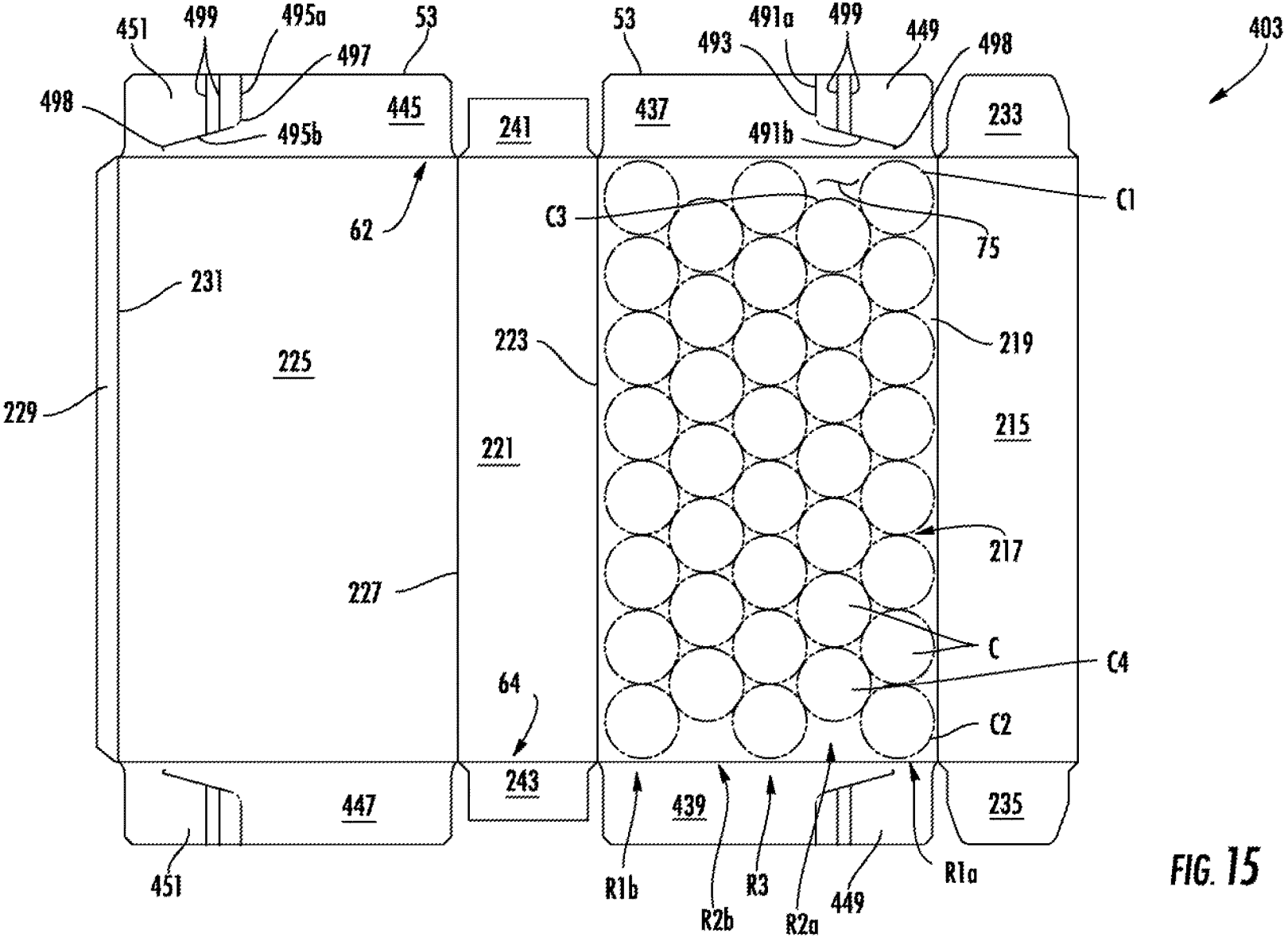
FIG. 15 is a plan view of a blank for forming a carton according to a third embodiment of the disclosure.
Figure 16:
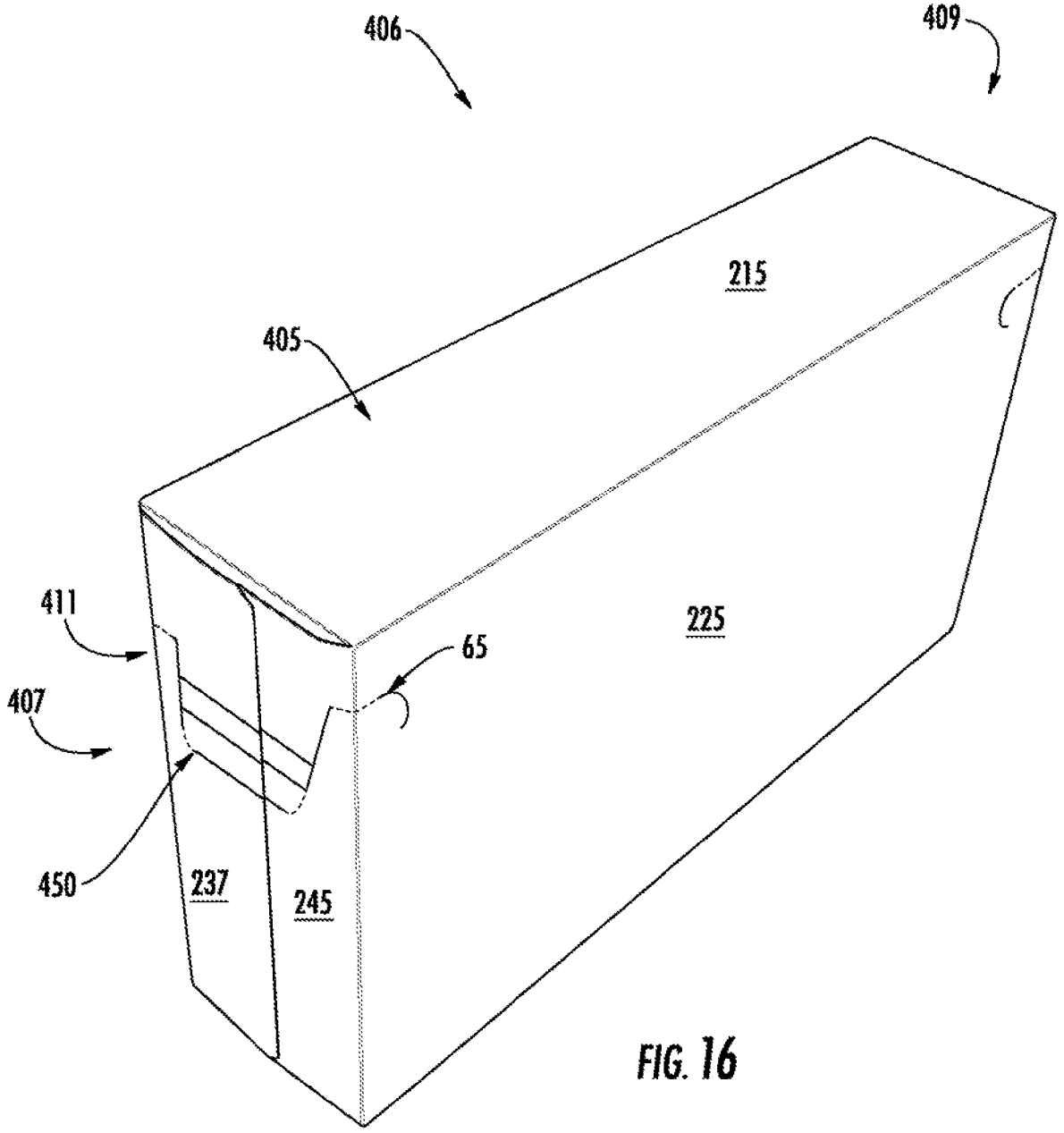
FIG. 16 is a perspective view of a package including the erected carton according to the third embodiment of the disclosure.
Figure 17A:
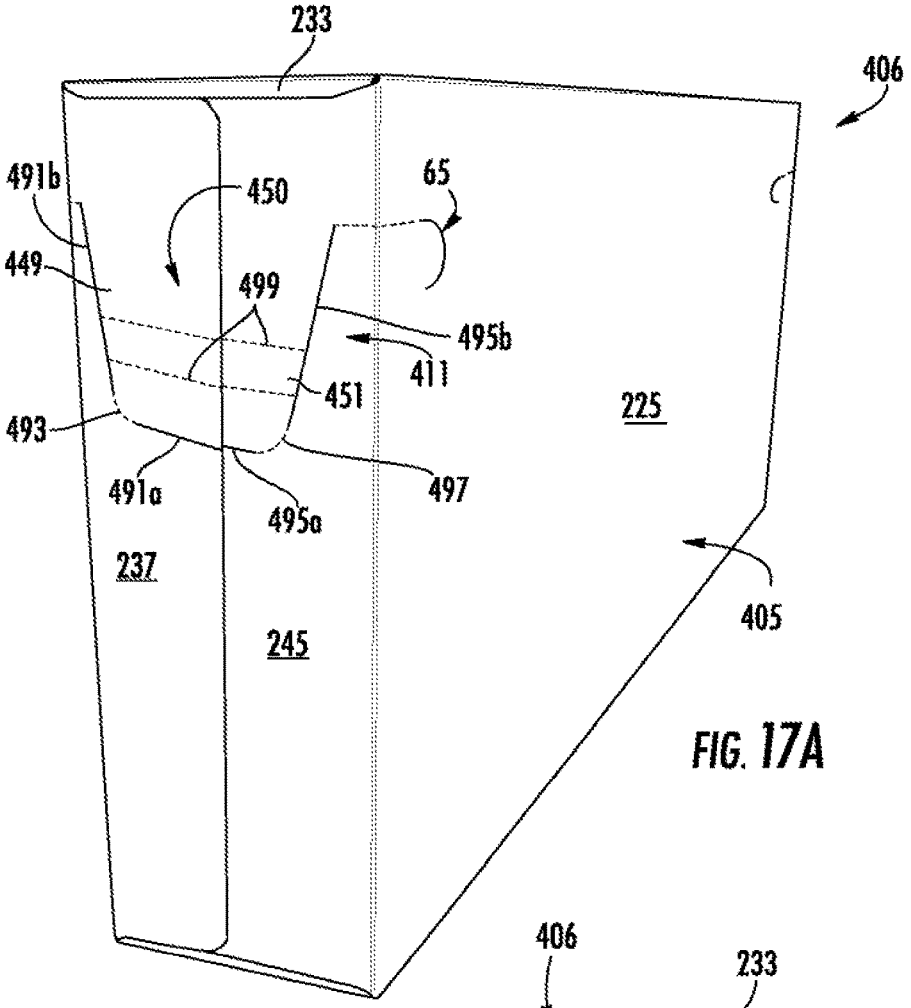
FIGS. 17A-18C are perspective views of the handle of the package of FIG. 16.
Figure 17B:
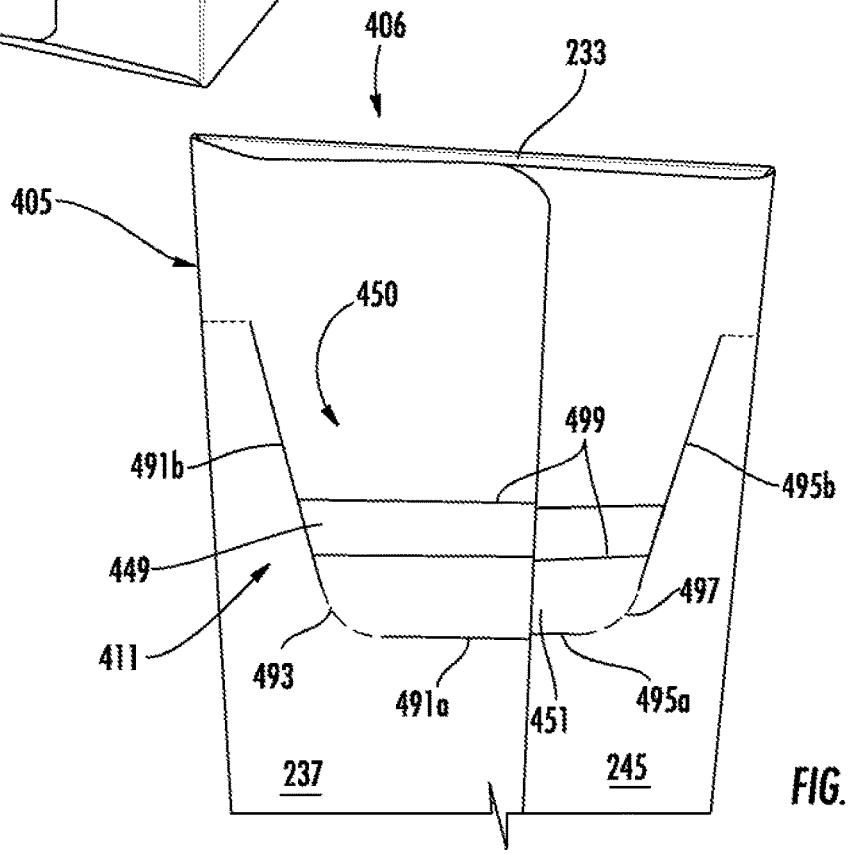
Figure 18A:
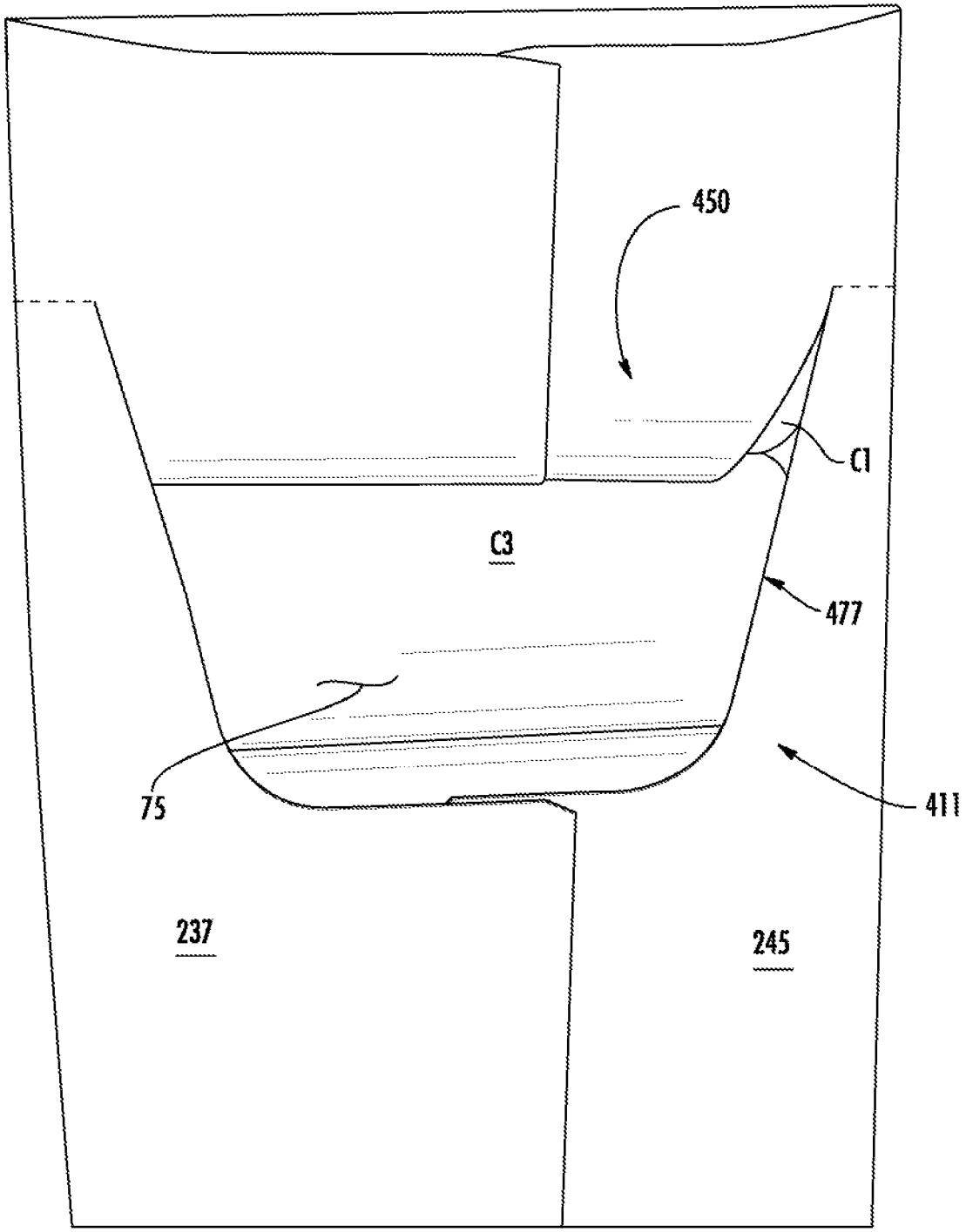
Figure 18B:
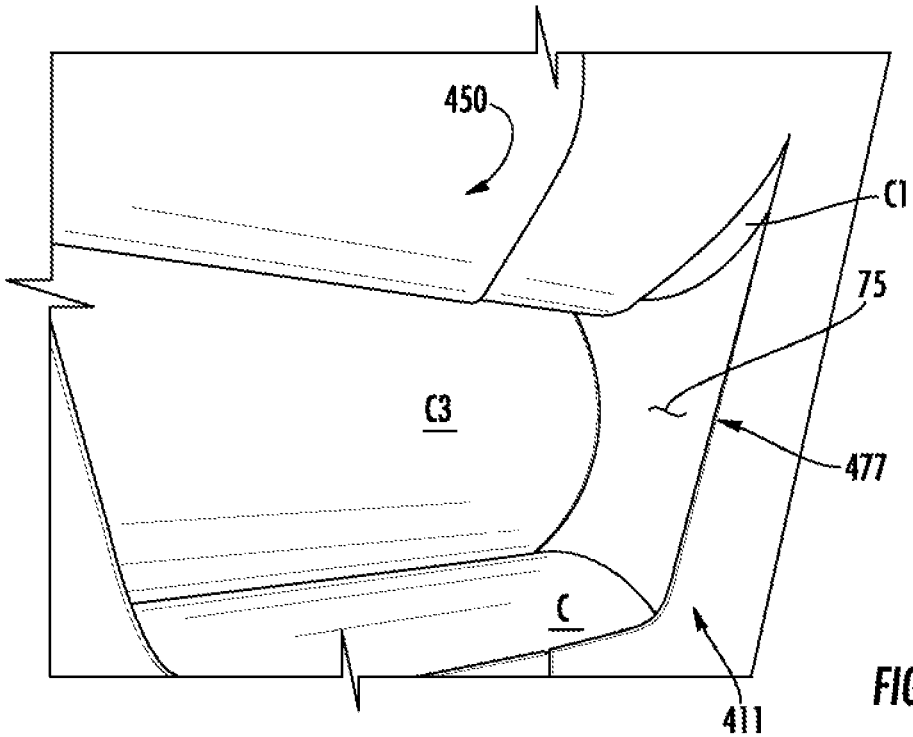
Figure 18C:
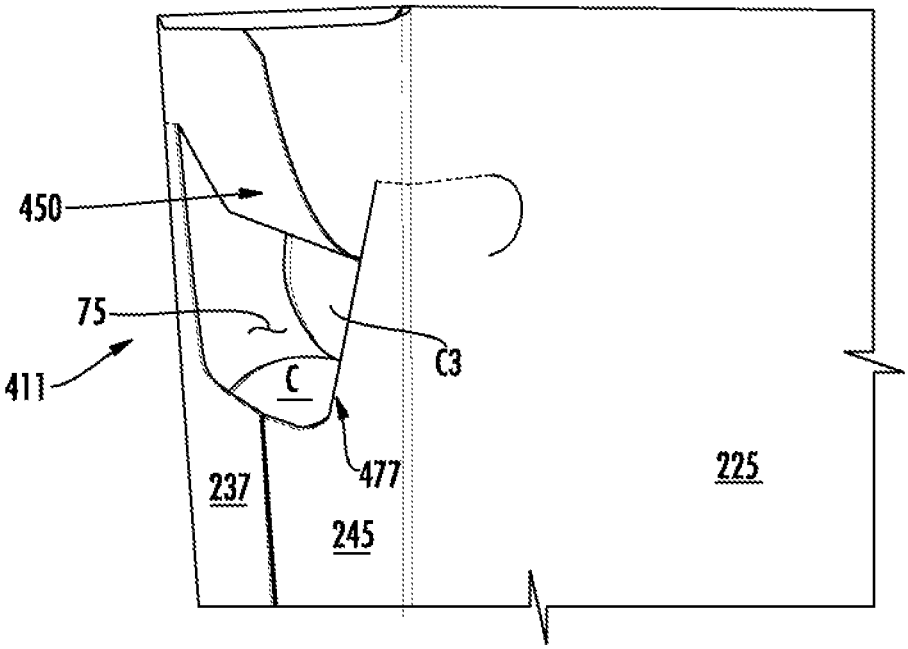

FIG. 15 is a plan view of a blank 403 for forming a carton 405 and a package 406 (FIG. 16) of a third embodiment of the disclosure. The third embodiment is generally similar to the first and second embodiments, except for variations noted and variations that will be apparent to one of ordinary skill in the art. Accordingly, similar or identical features of the embodiments have been given like or similar reference numbers. The handle features of the blank 403 include a handle flap portion 449 in each of the side end flaps 437, 439 and a handle flap portion 451 in each of the side end flaps 445, 447. As shown in FIG. 15, each of the handle flap portions 449 is separable from the respective side end flap 437, 439 along a lateral cut line 491*a*, an oblique cut line 491*b*, and a curved tear line 493, and each of the handle flap portions 451 is separable from the respective side end flap 445, 447 along a lateral cut line 495*a*, an oblique cut line 495*b*, and a curved tear line 497. In the illustrated embodiment, the lateral cut lines 491*a*, 495*a* can extend to the longitudinally-extending edges 53 of the respective side end flap, and the oblique cut lines 491*b*, 495*b* can terminate in a respective hook-shaped tear stop 498. In one embodiment, the handles can include optional tear stops 65 extending adjacent the ends of the oblique tear lines 491*b*, 495*b* (e.g., see FIGS. 16-17B) instead of or in addition to the hook-shaped tear stops 498 shown in FIG. 15. As shown in FIG. 15, the flap portions 449, 451 each can include two lateral fold lines 499 extending to the respective free edge 53 and to the respective oblique fold line 491*b*, 495*b*.

The handle flap portions 449, 451 and the handle flaps 450 formed therefrom in the closed ends 407, 409 of the carton 405 are generally longer than the handle flap portions 249, 251 and the handle flaps 250 of the second embodiment. Accordingly, the handle flaps 450 can fold farther along the end containers C1, C2 of the top row R1*a*. Additionally, the flap portions 449, 451 can fold along the lateral fold lines 499 so that the handle flaps 450 at least partially fold around a user's fingers (e.g., to help prevent the fingers from being caught and/or pinched between the containers). The handle features could be otherwise shaped, arranged, and/or configured without departing from the disclosure. For example, the handle flap portions could be separable from the end flaps along tear lines, cut lines, cut lines with one or more nicks, and/or combinations thereof.

In the illustrated embodiment, when the handles 411 are actuated, the handle flaps 450 formed by the partially overlapping handle flap portions 449, 451 at each end 407, 409 can be pushed inwardly so that the handle flap portions 449, 451 at least partially separate from the respective end flaps along cut lines 491*a*, 491*b*, 495*a*, 495*b* and the tear lines 493, 497. The hook-shaped tear stops 498 (or tear stops 65) at the ends of the oblique cut lines 491*b*, 495*b* can help stop the separating of the handle flap portions 449, 451 from the end flaps and can help prevent unwanted tearing of the end flaps. The handle flaps 450 can fold along a region of the respective end flaps adjacent the hook-shaped tear stops 498 (or tear stops 65). In an alternative embodiment, the handle flap portions 449, 451 could be foldably connected to the respective side end flaps along respective fold lines. As the user pushes the handle flaps 450 inwardly, the user can grasp the end containers at the ends of the top row R1*a*, and the handle flaps 450 can at least partially curve around the end containers between the user's hands and the end containers. The handle flaps 450 can fold along the lateral fold lines 499 to be pushed between adjacent containers C and/or to protect the user's hands, for example.

The handle features, the blank 403, the handles 411, the carton 405, and/or the package 406 could be otherwise shaped, arranged, and/or configured without departing from the disclosure. For example, one of the handles 411 could be omitted.

Figure 19:
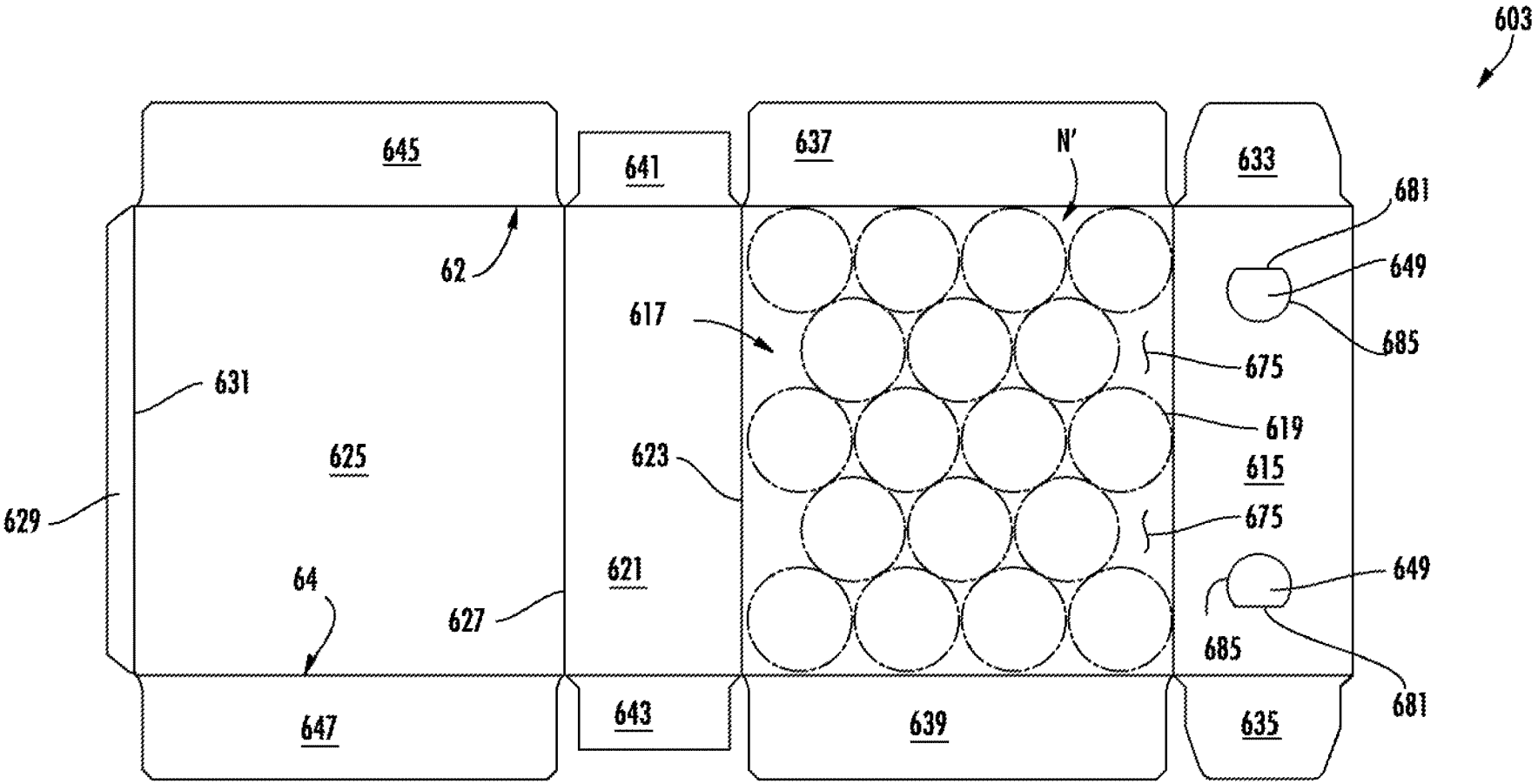
FIG. 19 is a plan view of a blank for forming a carton according to a fourth embodiment of the disclosure.

FIG. 19 is a plan view of a blank 603 for forming a carton 605 and a package 606 (FIG. 20) of a fourth embodiment of the disclosure. The fourth embodiment is generally similar to the above embodiments, except for variations noted and variations that will be apparent to one of ordinary skill in the art. Accordingly, similar or identical features of the embodiments have been given like or similar reference numbers. In the fourth embodiment, the blank 603 includes handle features in the top panel 615. For example, the handle features can include two handle flaps 649 for forming respective handle openings (not shown) at opposite ends of the top panel 615.

Figure 20:
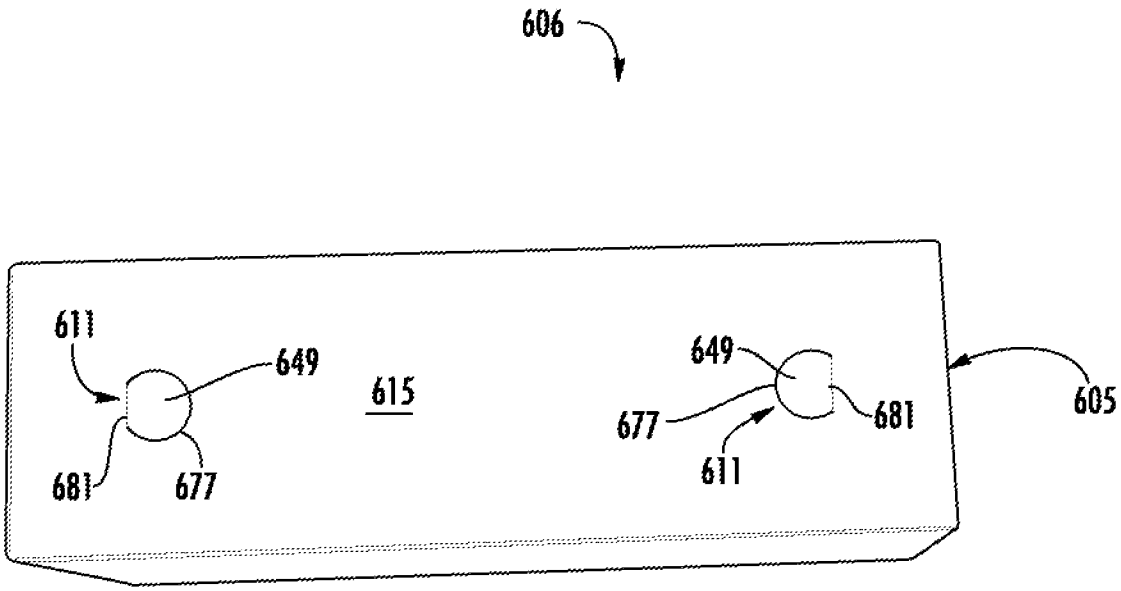
FIG. 20 is a perspective view of a package including the erected carton according to the fourth embodiment of the disclosure.

As schematically shown in FIG. 19, the containers C are arranged in an internally nested arrangement N' that is similar to the nested arrangement N in the previous embodiments, except that the rows of the containers C in the nested arrangement N' extend generally perpendicular to the top panel in FIG. 20. Voids 675 similar to the voids 75 in the previous embodiments are formed in the nested arrangement N' as shown in FIG. 19. The voids 675 are disposed adjacent the handle flaps 649 in the top panel 615. Accordingly, a user can insert a thumb, for example, into the handle openings formed by folding the handle flaps 649 inwardly (not shown) and grasp the end containers of the end rows to lift, carry, and/or hold the package 606. The handles 611, the carton 605, and/or the package 606 could be otherwise shaped, arranged, positioned, and/or configured without departing from the disclosure.

FIGS. 21 and 22 and the above incorporated-by-reference applications show exemplary arrangements including fully nested arrangements, internal nested arrangements, and other arrangements of containers that could be used with the illustrated embodiments and/or other non-illustrated embodiments of the disclosure. Additionally, the above incorporated-by-reference applications show alternative carton arrangements that could be incorporated into the above embodiments or other embodiments.

Any of the features of the various embodiments of the disclosure can be combined with, replaced by, or otherwise configured with other features of other embodiments of the disclosure without departing from the scope of this disclosure. Further, it is noted that the nesting arrangements of the various embodiments can be incorporated into a carton having any carton style or panel configuration. The carton styles and panel configurations described above are included by way of example.

The blanks according to any of the embodiments of the present disclosure can be, for example, formed from coated paperboard and similar materials. For example, the interior and/or exterior sides of the blank can be coated with a clay coating. The clay coating may then be printed over with product, advertising, price coding, and other information or images. The blank may then be coated with a varnish to protect any information printed on the blank. The blank may also be coated with, for example, a moisture barrier layer, on either or both sides of the blank. In accordance with the above-described embodiments, the blank may be constructed of paperboard of a caliper such that it is heavier and more rigid than ordinary paper. The blank can also be constructed of other materials, such as cardboard, hard paper, or any other material having properties suitable for enabling the carton to function at least generally as described herein. The blank can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package comprising a carton and a plurality of articles, the carton comprising;

a plurality of panels that extends at least partially around an interior of the carton;

the plurality of articles being arranged in a plurality of rows of articles in the interior of the carton, the plurality of rows of articles comprising at least a first row and a second row, and the first row comprising at least one more article than the second row forming a void between a first article at an end of the first row and a second article at an end of the second row; and a handle comprising the first article at the end of the first row and a handle flap extending in the carton, the handle flap being at least partially aligned with the void and being proximate the first article at the end of the first row, wherein the handle flap is positionable between a first position preventing access to the void and a second position wherein the handle flap is folded inwardly to at least partially form a handle opening that is at least partially in communication with the void.

2. The package of claim 1, further comprising at least two end flaps respectively foldably attached to respective panels of the plurality of panels, the at least two end flaps at least partially forming a closed end of the carton, wherein the handle flap is foldably connected to at least one end flap of the at least two end flaps.

3. The package of claim 2, wherein the handle flap is foldably connected to the at least one end flap along a fold line.

4. The package of claim 2, wherein the at least two end flaps comprise at least a first end flap and a second end flap, and the handle flap comprises a first handle flap portion extending in the first end flap and a second handle flap portion extending in at least the second end flap.

5. The package of claim 4, wherein the first end flap comprises a first upper extension, the second end flap comprises a second upper extension, the first handle flap portion is foldably connected to the first upper extension, the second handle flap portion is foldably connected to the second upper extension, and the first upper extension and the second upper extension at least partially overlap the first article at the end of the first row.

6. The package of claim 5, wherein the at least two end flaps further comprise a third end flap, and each of the handle flap, the first upper extension, and the second upper extension at least partially overlap the third end flap.

7. The package of claim 4, wherein each of the first handle flap portion and the second handle flap portion is at least partially separable from the respective first end flap and second end flap along a respective tear line.

8. The package of claim 2, wherein the handle flap is generally coplanar with the at least one end flap at the first position.

9. The package of claim 2, wherein the at least two end flaps comprise at least a first end flap and a second end flap, the handle flap is foldably connected to at least the first end flap, and each of the first end flap and the handle flap at least partially overlaps the second end flap.

10. The package of claim 1, wherein in the second position the handle flap is folded at least partially into the void to engage the first article at the end of the first row.

11. The package of claim 1, wherein the handle further comprises at least one lateral fold line extending in the handle flap.

12. The package of claim 1, wherein in the second position the handle flap is folded with respect to a remainder of the carton along at least one fold line and is separated from at least a portion of the carton along at least one cut.

13. The package of claim 1, wherein in the first position the handle flap is generally coplanar with at least an adjacent portion of the carton.

14. The package of claim 1, wherein the plurality of panels comprises at least a top panel, a first side panel, and a second side panel, the second row being spaced apart from the top panel by at least the first row.

15. The package of claim 14, further comprising at least two end flaps respectively foldably attached to respective panels of the plurality of panels, the at least two end flaps at least partially forming a closed end of the carton, wherein the at least two end flaps comprise at least a first side end flap foldably connected to the first side panel and a second side end flap foldably connected to the second side panel, and the handle flap extends in at least the first side end flap and the second side end flap.

16. The package of claim 1, wherein the handle flap is at least partially defined by a tear line, and the handle further comprises a tear stop extending from an edge of the tear line.

17. A method of forming a package comprising:

obtaining a blank comprising a plurality of panels and a handle feature;

forming an interior of a carton at least partially defined by the plurality of panels;

arranging a plurality of articles in a plurality of rows of articles, the plurality of rows of articles comprising at least a first row and a second row, and the first row comprising at least one more article than the second row forming a void between a first article at an end of the first row and a second article at an end of the second row;

disposing the plurality of articles at least partially in the interior of the carton; and forming a handle from the handle feature and the first article at the end of the first row, the handle comprising a handle flap extending in the carton, the forming the handle comprising at least partially aligning the handle flap with the void to be proximate the first article at the end of the first row, wherein the handle flap is positionable between a first position preventing access to the void and a second position wherein the handle flap is folded inwardly to at least partially form a handle opening that is at least partially in communication with the void.

18. The method of claim 17, further comprising positioning the handle flap to the second position by folding the handle flap inwardly at least partially into the void to engage the first article at the end of the first row.

19. The method of claim 17, further comprising carrying the carton at the handle comprising positioning the handle in the second position and grasping at least the first article at the end of the first row and the handle flap via the handle opening.

20. The method of claim 17, wherein the blank further comprises at least two end flaps respectively foldably attached to respective panels of the plurality of panels, and the method further comprises forming an at least partially closed end of the carton by at least partially overlapping the at least two end flaps, wherein the handle flap is foldably connected to at least one end flap of the at least two end flaps.

21. The method of claim 20, wherein the at least two end flaps comprise a first end flap and a second end flap, the handle feature comprises at least a first handle flap portion foldably connected to the first end flap and a second handle flap portion foldably connected to the second end flap, and the forming the handle comprises at least partially overlapping the first handle flap portion and the second handle flap portion to at least partially form the handle flap.

22. A carton for containing a plurality of articles arranged in a plurality of rows of articles comprising at least a first row and a second row, the first row having at least one more article than the second row forming a void between a first article at an end of the first row and a second article at an end of the second row, the carton comprising:

a plurality of panels that extends at least partially around an interior of the carton for containing the plurality of articles; and a handle comprising a handle flap extending in the carton, the handle comprising the first article at the end of the first row when the plurality of articles is contained in the carton, wherein the handle flap is at least partially aligned with the void, is proximate the first article at the end of the first row, and is positionable between a first position preventing access to the void and a second position wherein the handle flap is folded inwardly to at least partially form a handle opening that is at least partially in communication with the void.

23. The carton of claim 22, further comprising at least two end flaps respectively foldably attached to respective panels of the plurality of panels, the at least two end flaps at least partially forming a closed end of the carton, wherein the handle flap is foldably connected to at least one end flap of the at least two end flaps.

24. The carton of claim 23, wherein the handle flap is foldably connected to the at least one end flap along a fold line.

25. The carton of claim 23, wherein the at least two end flaps comprise at least a first end flap and a second end flap, and the handle flap comprises a first handle flap portion extending in the first end flap and a second handle flap portion extending in at least the second end flap.

26. The carton of claim 25, wherein the first end flap comprises a first upper extension, the second end flap comprises a second upper extension, the first handle flap portion is foldably connected to the first upper extension, the second handle flap portion is foldably connected to the second upper extension, and the first upper extension and the second upper extension are for at least partially overlapping the first article at the end of the first row.

27. The carton of claim 26, wherein the at least two end flaps further comprise a third end flap, and each of the handle flap, the first upper extension, and the second upper extension at least partially overlap the third end flap.

28. The carton of claim 25, wherein in each of the first handle flap portion and the second handle flap portion is at least partially separable from the respective first end flap and second end flap along a respective tear line.

29. The carton of claim 23, wherein in the first position of the handle, the handle flap is generally coplanar with the at least one end flap.

30. The carton of claim 23, wherein the at least two end flaps comprise at least a first end flap and a second end flap, the handle flap is foldably connected to at least the first end flap, and each of the first end flap and the handle flap at least partially overlaps the second end flap.

31. The carton of claim 22, wherein in the second position of the handle, the handle flap is folded at least partially into the void to engage the first article at the end of the first row.

32. The carton of claim 22, wherein the handle further comprises at least one lateral fold line extending in the handle flap.

33. The carton of claim 22, wherein the handle flap is foldable with respect to a remainder of the carton along at least one fold line and is separable from at least a portion of the carton along at least one cut.

34. The carton of claim 22, wherein in the first position of the handle, the handle flap is generally coplanar with at least an adjacent portion of the carton.

35. The carton of claim 22, wherein:

the plurality of panels comprises at least a top panel, a first side panel, and a second side panel;

the second row is for being spaced apart from the top panel by at least the first row when the plurality of articles is contained in the carton;

the carton further comprises at least two end flaps respectively foldably attached to respective panels of the plurality of panels, the at least two end flaps at least partially forming a closed end of the carton;

the at least two end flaps comprise at least a first side end flap foldably connected to the first side panel and a second side end flap foldably connected to the second side panel; and the handle flap extends in at least the first side end flap and the second side end flap.

36. The carton of claim 22, wherein the handle flap is at least partially defined by a tear line, and the handle further comprises a tear stop extending from an edge of the tear line.

37. A blank for forming a carton for holding a plurality of articles arranged in a plurality of rows of articles comprising at least a first row and a second row, the first row having at least one more article than the second row forming a void between a first article at an end of the first row and a second article at an end of the second row, the blank comprising;

a plurality of panels; and a handle feature extending in the blank for at least partially forming a handle when the carton is formed from the blank, the handle comprising a handle flap;

wherein the handle comprises the first article at the end of the first row when the plurality of articles is contained in the carton formed from the blank, and the handle flap is for being at least partially aligned with the void, is for being proximate the first article at the end of the first row, and is for being positionable between a first position preventing access to the void and a second position wherein the handle flap is folded inwardly to at least partially form a handle opening that is at least partially in communication with the void when the plurality of articles is contained in the carton formed from the blank.

38. The blank of claim 37, further comprising at least two end flaps respectively foldably attached to respective panels of the plurality of panels, the at least two end flaps being for at least partially forming a closed end of the carton formed from the blank, wherein the handle feature comprises a handle flap portion foldably connected to at least one end flap of the at least two end flaps, and the handle flap portion is for forming at least a portion of the handle flap when the carton is formed from the blank.

39. The blank of claim 38, wherein the at least two end flaps comprise at least a first end flap and a second end flap, the handle flap portion comprises a first handle flap portion extending in the first end flap, the handle feature further comprises a second handle flap portion extending in at least the second end flap, and the first handle flap portion and the second handle flap portion are for at least partially forming the handle flap when the carton is formed from the blank.

40. The blank of claim 39, wherein the first end flap comprises a first upper extension, the second end flap comprises a second upper extension, the first handle flap portion is foldably connected to the first upper extension, the second handle flap portion is foldably connected to the second upper extension, and the first upper extension and the second upper extension are for at least partially overlapping the first article at the end of the first row when the plurality of articles is contained in the carton is formed from the blank.

41. The blank of claim 39, wherein each of the first handle flap portion and the second handle flap portion is at least partially separable from the respective first end flap and second end flap along a respective tear line.

42. The blank of claim 38, wherein the handle feature further comprises at least one lateral fold line extending in the handle flap portion.

43. The blank of claim 38, wherein the handle flap portion is generally coplanar with the at least one end flap.

44. The blank of claim 37, wherein the handle feature is at least partially defined by a tear line, and a tear stop extends from an edge of the tear line.

45. The carton of claim 1, wherein the interior of the carton is accessible from the exterior of the carton through the handle opening.

* * * * *